US005273868A

United States Patent [19]

Sakurazawa et al.

[11] Patent Number: 5,273,868

[45] Date of Patent: Dec. 28, 1993

[54] SILVER HALIDE COLOR PHOTOGRAPHIC MATERIALS

[75] Inventors: Mamoru Sakurazawa; Hidetoshi Kobayashi, both of Kanagawa, Japan

[73] Assignee: Fuji Photo Film Co., Ltd., Minami-ashigara, Japan

[21] Appl. No.: 793,008

[22] Filed: Nov. 15, 1991

[30] Foreign Application Priority Data

Nov. 17, 1990 [JP] Japan ..... 2-312406

[51] Int. Cl.[5] ..... G03C 7/38; G03C 7/36

[52] U.S. Cl. ..... 430/505; 430/556; 430/557; 430/558

[58] Field of Search ..... 430/505, 556, 557, 558, 430/558 A

[56] References Cited

U.S. PATENT DOCUMENTS

| | | | |
|---|---|---|---|
| 3,725,067 | 3/1973 | Bailey et al. | 430/558 |
| 4,268,591 | 5/1981 | Tschopp | 430/558 |
| 4,500,630 | 2/1985 | Sato et al. | 430/558 |
| 4,540,654 | 9/1985 | Sato et al. | 430/558 |
| 4,857,444 | 8/1989 | Hirose et al. | 430/558 |
| 5,118,599 | 6/1992 | Lau et al. | 430/557 |

*Primary Examiner*—Lee C. Wright

[57] ABSTRACT

A silver halide color photographic material comprising a support having thereon at least one blue sensitive silver halide emulsion layer, at least one green sensitive silver halide emulsion layer and at least one red sensitive silver halide emulsion layer, wherein at least one type of acylacetamide type yellow coupler in which the acyl group represented by formula [I] indicated below is included in said blue sensitive silver halide emulsion layer and at least one type of magenta coupler represented by formula [M] indicated below is included in said green sensitive silver halide emulsion layer, Formula [I]

wherein $R_1$ represents a univalent group, Q represents a group of non-metal atoms which, together with C, is required to form a three to five membered hydrocarbon ring or a three to five membered heterocyclic ring which has within the ring at least one hetero atom selected from the group consisting of N, O, S and P, with the proviso with $R_1$ is not a hydrogen atom and is not linked to Q and does not form a ring, Formula [M]

wherein $R_{20}$ represents a hydrogen atom or a substituent group, Z represents a group of non-metal atoms which is required to form a five membered azole ring which contains 2 to 4 nitrogen atoms, said azole rings may have substituent groups including condensed rings, and X represents a hydrogen atom or a coupling-off group.

18 Claims, No Drawings

SILVER HALIDE COLOR PHOTOGRAPHIC MATERIALS

FIELD OF THE INVENTION

The present invention relates to silver halide color photographic materials and, more precisely, the present invention relates to photographic materials which have excellent color reproduction properties and excellent stability during photographic processing.

BACKGROUND OF THE INVENTION

In recent years, progress has been made by increasing the speed and improving the image quality of color photographic photographic materials in response to the requirements of the user. With respect to the improvement of picture quality, progress has been made in the main with improvement of color reproduction, improvement of sharpness and improvement of graininess. These factors are of great importance when comparing the performance cf photographic materials, and it is clear that further improvement will be required in the future.

The dyes which are formed with the yellow, magenta and cyan couplers which have been used in silver halide color photographic materials in the past have tended to impair color reproduction because of unwanted auxiliary absorbances. Hence, couplers which form colored images with little auxiliary absorption have been subject to research as a means of improving color reproduction.

With magenta dyes, improvement of the magenta hue has been achieved by the use of pyrazoloazole based magenta couplers in place of the conventional 5-pyrazolone type magenta couplers. The azomethine dyes formed by reaction between these couplers and the oxidation products of color developing agents have a high saturation because there is little auxiliary absorption in the region of 430 nm which is deleterious with respect to color reproduction and it is known that these are desirable from the viewpoint of color reproduction. Such couplers have been disclosed, for example, in U.S. Pat. No. 3,725,067, JP-A-60-172982, JP-A-60-33552, JP-A-61-72238, U.S. Pat. Nos. 4,500,630 and 4,540,654. (The term "JP-A" as used herein signifies an "unexamined published Japanese patent application".)

Furthermore, in the past the yellow couplers have provided low saturation and improvement by sharpening the spectral absorption is very desirable. On the other hand, reduction of the film thickness of photographic materials is required to improve sharpness, but this requires the use of couplers which have good color forming properties in the emulsion layers and their emulsification and dispersion in a stable manner with a reduced quantity of high boiling point organic solvent. The yellow couplers from which the dyes are formed have a sharp absorption spectrum, they have excellent color reproduction and there is little variation in the color forming properties with changes in the pH of the color developer disclosed in JP-A-63-123047, for example, can be cited as couplers of this type.

However, according to observations made by the present inventors, the formation of the respective colored dyes when the above mentioned yellow couplers and pyrazoloazole based magenta couplers are used conjointly varies greatly depending on slight fluctuations in the pH of the color developer and color mixing and color staining occurs as a result of interlayer mixing of the oxidized developing agent into other layers. The resolution of these problems is desirable.

SUMMARY OF THE INVENTION

Hence, the first object of the present invention is to provide color photographic materials which have a high color saturation, with which there is little color mixing or color staining, and which have excellent color reproduction properties.

The second object of the present invention is to provide excellent color photographic materials having no fluctuation in photographic properties depending on the pH of the color developer.

As a result of thorough research, the inventors have discovered that the objects of the invention can be realized by the means indicated below.

Thus, the objects of the invention have been realized by means of a silver halide color photographic material comprising a support having thereon at least one blue sensitive silver halide emulsion layer, at least one green sensitive silver halide emulsion layer and at least one red sensitive silver halide emulsion layer, wherein at least one type of acylacetamide type yellow coupler in which the acyl group represented by formula [I] indicated below is included in said blue sensitive silver halide emulsion layer and at least one type of magenta coupler represented by formula [M] indicated below is included in said green sensitive silver halide emulsion layer,

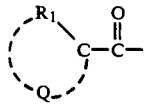

Formula [I]

wherein $R_1$ represents a univalent group, Q represents a group of non-metal atoms which, together with C, is required to form a three to five membered hydrocarbon ring or a three to five membered heterocyclic ring which has within the ring at least one hetero atom selected from the group consisting of N, O, S and P, with the proviso that $R_1$ is not a hydrogen atom and is not linked to Q and does not form a ring,

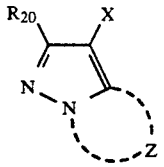

Formula [M]

wherein $R_{20}$ represents a hydrogen atom or a substituent group, Z represents a group of non-metal atoms which is required to form a five membered azole ring which contains 2 to 4 nitrogen atoms, said azole rings may have substituent groups (including condensed rings), and X represents a hydrogen atom or a coupling-off group (a group which can be eliminated at the time of a coupling reaction with the oxidized form of a developing agent).

DETAILED DESCRIPTION OF THE INVENTION

Silver halide color photographic materials which contain yellow couplers and pyrazoloazole based magenta couplers which have sharp absorption spectra and which provide excellent color reproduction have been disclosed in JP-A-63-231451, but there is no mention whatsoever of yellow couplers of the present invention and no disclosure of the same is made.

The acylacetamide type yellow couplers of the present invention are preferably represented by formula [Y] indicated below.

Formula [Y]

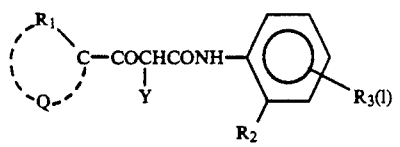

In formula [Y], $R_1$ represents a univalent group other than hydrogen, Q represents a group of non-metal atoms which is required, together with C, to form a three to five membered hydrocarbon ring or a three to five membered heterocyclic ring which contains within the ring at least one hetero atom selected from among N, S, O and P, $R_2$ represents a hydrogen atom, a halogen atom (F, Cl, Br, I; same in formula [Y] described hereinafter), an alkoxy group, an aryloxy group, an alkyl group or an amino group, $R_3$ represents a group which can be substituted onto a benzene ring, Y represents a hydrogen atom or a group which can be eliminated by a coupling reaction with the oxidized form of a primary aromatic amine developing agent (referred to hereinafter as a coupling-off group) and l represents an integer from 0 to 4. Moreover, when l represents 2 or more the $R_3$ groups may be the same or different.

Examples of R3 include halogen atoms, alkyl groups, aryl groups, alkoxy groups, aryloxy groups, alkoxycarbonyl groups, aryloxycarbonyl groups, carbonamido groups, sulfonamido groups, carbamoyl groups, sulfamoyl groups, alkylsulfonyl groups, ureido groups, sulfamoylamino groups, alkoxycarbonylamino groups, alkoxysulfonyl groups, acyloxy groups, nitro groups, heterocyclic groups, cyano groups, acyl groups, alkylsulfonyloxy groups and arylsulfonyloxy groups. Examples of coupling-off group include heterocyclic groups which are bonded to the coupling position with a nitrogen atom, aryloxy groups, arylthio groups, acyloxy groups, alkylsulfonyloxy groups, arylsulfonyloxy groups, heterocyclic oxy groups and halogen atoms.

When the substituent groups in formula [Y] are alkyl groups or contain alkyl groups, and no particular limitation is imposed, the term alkyl group signifies linear chain, branched chain or cyclic alkyl groups which may be substituted and which may contain unsaturated bonds (for example, methyl, isopropyl, tert-butyl, cyclopentyl, tert-pentyl, cyclohexyl, 2-ethylhexyl, 1,1,3,3-tetramethylbutyl, dodecyl, hexadecyl, allyl, 3-cyclohexenyl, olel, benzyl, trifluoromethyl, hydroxymethylmethoxyethyl, ethoxycarbonylmethyl, phenoxyethyl).

When the substituent groups in formula [Y] are aryl groups or contain aryl groups, and no particular limitation is imposed, the term aryl groups signifies single ring or condensed ring aryl groups which may have substituent groups (for example, phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-tert-pentylphenyl, p-methanesulfonamidophenyl, 3,4-dichlorophenyl).

When the substituent groups in formula [Y] are heterocyclic groups or contain heterocyclic rings, and no particular limitation is imposed, the term heterocyclic group signifies a three to eight membered single ring or condensed ring heterocyclic group which may be substituted and which contains at least one hetero atom selected from among O, N, S, P, Se and Te (for example, 2-furyl, 2-pyridyl, 4-pyridyl, 1-pyrazolyl, 1-imidazolyl, 1 benzotriazolyl, 2-benzotriazolyl, succinimido, phthalimido, 1-benzyl-2,4-imidazolidinedione-3-yl).

The substituent groups preferably used in formula [Y] are described below.

In formula [Y], $R_1$ is preferably a halogen atom, a cyano group or a univalent group which has a total of 1 to 30 carbon atoms (referred to hereinafter as the C-number) (for example, alkyl, alkoxy) or a univalent group of C-number from 6 to 30 (for example aryl, aryloxy), which may be substituted, and examples of substituent groups include halogen atoms, alkyl groups, alkoxy groups, nitro groups, amino groups, carbonamido groups, sulfonamido groups and acyl groups.

In formula [Y], Q preferably represents a group of non-metal atoms which is required, along with C, to form a three to five membered hydrocarbyl ring of C-number from 3 to 30 or a three to five membered heterocyclic ring of C-number from 2 to 30 which contains within the ring at least one hetero atom selected from among N, S, O and P, which may be substituted. Furthermore, the ring which is formed by Q together with C may contain unsaturated bonds within the ring. Cyclopropane, cyclobutane, cyclopentane, cyclopropene, cyclobutene, cyclopentene, oxethane, oxolane, 1,3-dioxolane, thiethane, thiolane and pyrrolidine rings are examples of rings formed by Q together with C. Examples of substituent groups include halogen atoms, hydroxyl groups, alkyl groups, aryl groups, acyl groups, alkoxy groups, aryloxy groups, cyano groups, alkoxycarbonyl groups, alkylthio groups and arylthio groups.

In formula [Y], $R_2$ is preferably a halogen atom or an alkoxy group of C-number from 1 to 30, an aryloxy group of C-number from 6 to 30, an alkyl group of C-number from 1 to 30 or an amino group of C-number from 0 to 30, and these may be substituted, and examples of substituent groups include halogen atoms, alkyl groups, alkoxy groups and aryloxy groups. $R_2$ is more preferably a halogen atom.

In formula [Y], $R_3$ is preferably a halogen atom, or an alkyl group of C-number from 1 to 30, an aryl group of C-number from 6 to 30, an alkoxy group of C-number from 1 to 30, an alkoxycarbonyl group of C-number from 2 to 30, an aryloxycarbonyl group of C-number from 7 to 30, a carbonamido group of C-number from 1 to 30, a sulfonamido group of C-number 1 to 30, a carbamoyl group of C-number 1 to 30, a sulfamoyl group of C-number from 0 to 30, an alkylsulfonyl group of C-number from 1 to 30, an arylsulfonyl group of C-number from 6 to 30, a ureido group of C-number from 1 to 30, a sulfamoylamino group of C number from 0 to 30, an alkoxycarbonylamino group of C-number from 2 to 30, a heterocyclic group of C-number from 1 to 30, an acyl group of C-number from 1 to 30, an alkylsulfonyloxy group of C-number from 1 to 30 or an arylsulfonyloxy group of C-number from 6 to 30, and these groups may be substituted. Examples of substituent groups include halogen atoms, alkyl groups, aryl groups, heterocyclic groups, alkoxy groups, aryloxy groups, heterocyclic oxy groups, alkylthio groups, arylthio groups, heterocyclic thio groups, alkylsulfonyl groups, arylsulfonyl groups, acyl groups, carbonamido groups, sulfonamido groups, carbamoyl groups, sulfamoyl groups, alkoxycarbonylamino groups, sulfamoylamino groups, ureido groups, cyano groups, nitro groups, acyloxy groups, alkoxycarbonyl groups, aryloxycarbonyl groups, alkylsulfonyloxy groups and arylsulfonyloxy groups. $R_3$ is more preferably a carbonamido group or sulfonamido group.

In formula [Y], l preferably represents an integer value of 1 or 2, and the substitution position of $R_3$ is preferably meta or para with respect to the

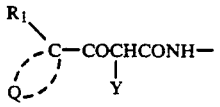

In formula [Y], Y preferably represents a heterocyclic group which is bonded to the coupling position with a nitrogen atom or an aryloxy group.

When Y represents a heterocyclic group it is preferably a five to seven membered single ring or condensed ring heterocyclic group which may be substituted, and examples include succinimido, maleimido, phthalimido, diglycolimido, pyrrole, pyrazole, imidazole, 1,2,4-triazole, tetrazole, indole, indazole, benzimidazole, benzotriazole, imidazolidin-2,4-dione, oxazolidin-2,4-dione, thiazolidin-2,4-dione, imidazolidin-2-one, oxazolidin-2-one, thiazolidin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone-2-pyrazone, 2-amino-1,3,4-thiazolidine and 2-imino-1,3,4-thiazolidin-4-one, and these heterocyclic rings may be substituted. Examples of substituent groups for these heterocyclic rings include halogen atoms, hydroxyl groups, nitro groups, cyano groups, carboxyl groups, sulfo groups, alkyl groups, aryl groups, alkoxy groups, aryloxy groups, alkylthio groups, arylthio groups, alkylsulfonyl groups, arylsulfonyl groups, alkoxycarbonyl groups, aryloxycarbonyl groups, acyl groups, acyloxy groups, amino groups, carbonamido groups, sulfonamido groups, carbamoyl groups, sulfamoyl groups, ureido groups, alkoxycarbonylamino amino groups and sulfamoylamino groups. When Y represents an aryloxy group it is preferably an aryloxy group of C-number from 6 to 30, and this may be substituted with groups selected from among the substituent groups given in the case where Y is a heterocyclic group as described above. The preferred substituent groups for an aryloxy group are halogen atoms, a cyano group, a nitro group, a carboxyl group, a trifluoromethyl group, alkoxycarbonyl groups, a carbonamido group, sulfonamido groups, a carbamoyl groups, sulfamoyl groups, alkylsulfonyl groups, arylsulfonyl groups or a cyan group.

The substituent groups used most desirably in formula [Y] are described below.

$R_1$ is more desirably a halogen atom, or an alkyl group, and most desirably a methyl group. Q is most desirably a group of non-metal atoms wherein the ring which is formed together with C is a three to five membered hydrocarbon ring, for example

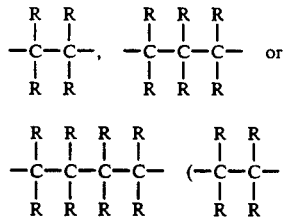

is most desirable). Here, R represents a hydrogen atom, a halogen atom or an alkyl group. Moreover, the R groups may be the same or different.

$R_2$ is more desirably a chlorine atom, a fluorine atom, an alkyl group of C-number from 1 to 6 (for example methyl, trifluoromethyl, ethyl, isopropyl, tert-butyl), an alkoxy group of C-number from 1 to 8 (for example, methoxy, ethoxy, methoxyethoxy, butoxy) or an aryloxy group of C-number from 6 to 24 (for example phenoxy, p-tolyloxy, p-methoxyphenoxy), and it is most desirably a chlorine atom, a methoxy group or a trifluoromethyl group.

$R_3$ is more desirably a halogen atom, an alkoxy group, an alkoxycarbonyl group, an aryloxycarbonyl group, a carbonamido group, a sulfonamido group, a carbamoyl group or a sulfamoyl group, and it is most desirably an alkoxy group, an alkoxycarbonyl group, a carboxnmido group or a sulfonamido group.

Y is most desirably a group which can be represented by formula [Y-1], [Y-2] or [Y-3] indicated below.

Formula [Y-1]

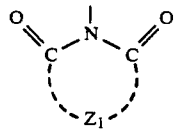

In formula [Y-1], $Z_1$ represents

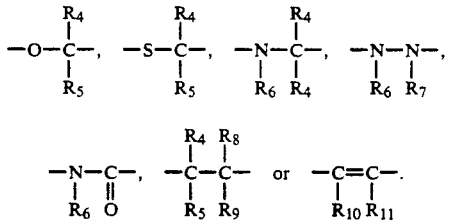

Here, $R_4$, $R_5$, $R_8$ and $R_9$ represent hydrogen atoms, alkyl groups, aryl groups, alkoxy groups, aryloxy groups, alkylthio groups, arylthio groups, alkylsulfonyl groups, arylsulfonyl groups or amino groups, $R_6$ and $R_7$ represent hydrogen atoms, alkyl groups, aryl groups, alkylsulfonyl groups, arylsulfonyl groups or alkoxycarbonyl groups, and $R_{10}$ and $R_{11}$ represent hydrogen atoms, alkyl groups or aryl groups. $R_{10}$ and $R_{11}$ may be joined together to form a benzene ring. $R_4$ and $R_5$, $R_5$ and $R_6$, $R_6$ and $R_7$, or $R_4$ and $R_8$ may be joined together to form a ring (for example, a cyclobutane, cyclohexane, cycloheptane, cyclohexene, pyrrolidine or piperidine ring).

The most desirable of the heterocyclic groups represented by formula [Y-1] are those in which $Z_1$ in formula [Y-1] is

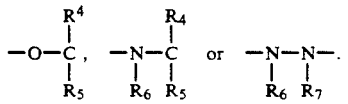

The C-number of the heterocyclic group represented by formula [Y-1] is from 2 to 30, preferably from 4 to 20 and most desirably from 5 to 16.

Formula [Y-2]

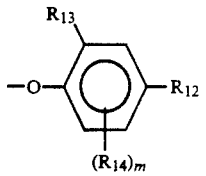

In formula [Y-2], at least one of $R_{12}$ and $R_{13}$ is selected from the group consisting of a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group or an acyl group, and the other may be a hydrogen atom, an alkyl group or an alkoxy group. $R_{14}$ represents a group having the same meaning as $R_{12}$ or $R_{13}$, and m represents an integer from 0 to 2. The C-number of the aryloxy groups represented by formula [Y-2] is from 6 to 30, preferably from 6 to 24, and most desirably from 6 to 15.

Formula [Y-3]

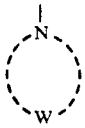

In formula [Y-3], W represents a group of non-metal atoms which is required, together with N, to form a pyrrole ring, a pyrazole ring, an imidazole ring or a triazole ring. Here, the ring represented by

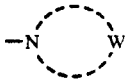

may have substituent groups, and halogen atoms, a nitro group, a cyano group, an alkoxycarbonyl group, an alkyl group, an aryl group, an amino group, an alkoxy group, an aryloxy group and a carbamoyl group are examples of preferred substituent groups. The C-number of the heterocyclic group represented by formula [Y-3] is from 2 to 30, preferably from 2 to 24, and most desirably from 2 to 16.

Y is most desirably a group which can be represented by formula [Y-1].

The couplers represented by formula [Y] may form dimers or larger oligomers with bonding between groups of valency two or more in the substituent groups $R_1$, Q, Y or

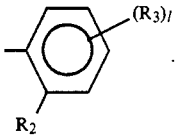

In such a case, the number of carbon atoms may be outside the range shown for each of the aforementioned substituent groups.

Actual examples of yellow couplers which can be represented by formula [Y] are indicated below.

Y-1

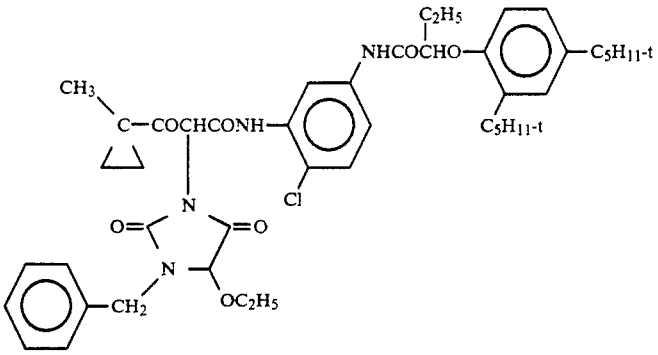

Y-2

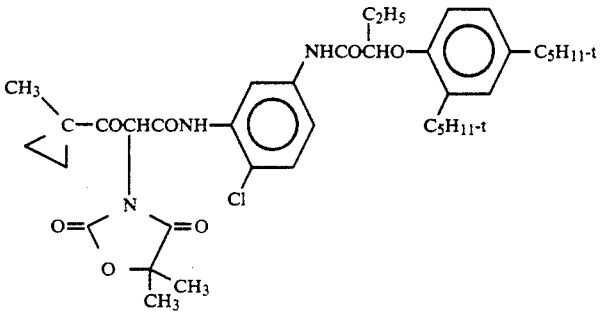

-continued
Y-3
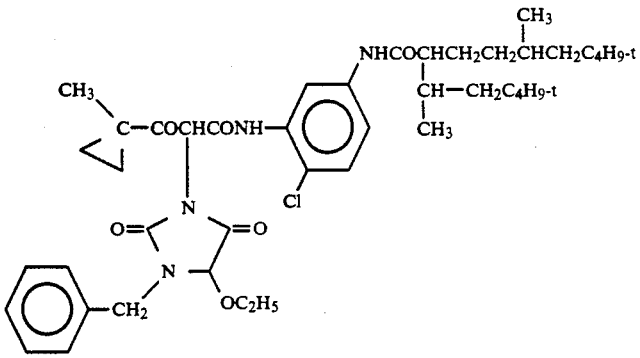
Y-4
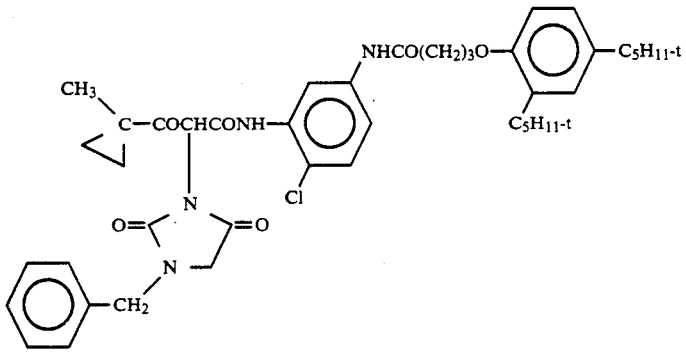
Y-5
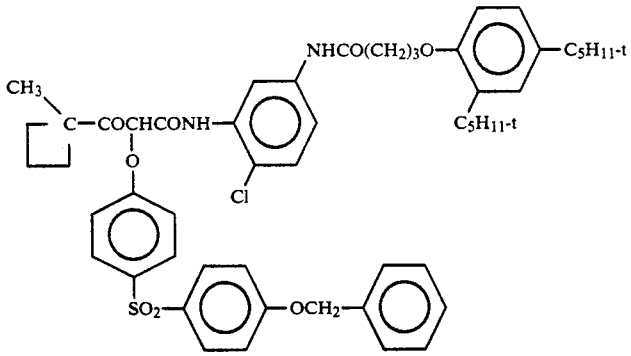
Y-6
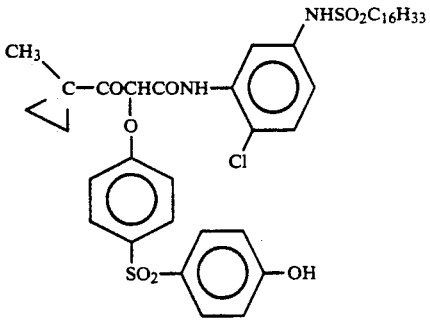

-continued
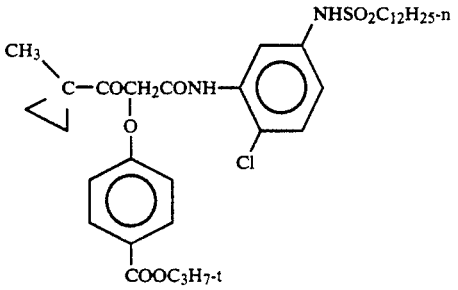
Y-7
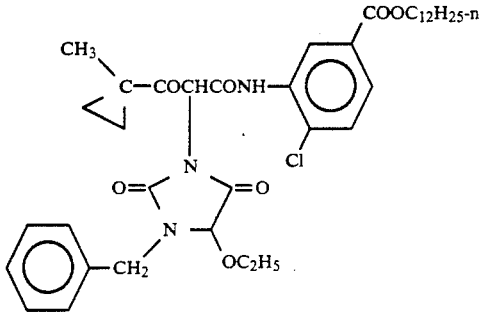
Y-8
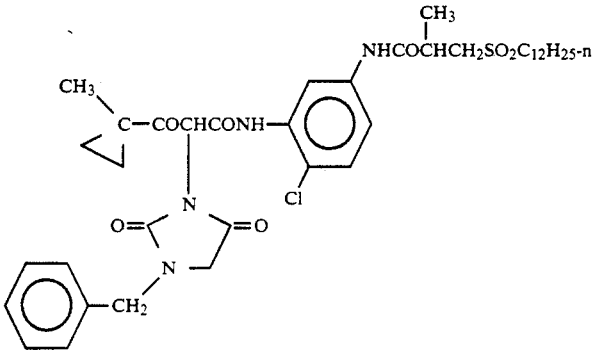
Y-9
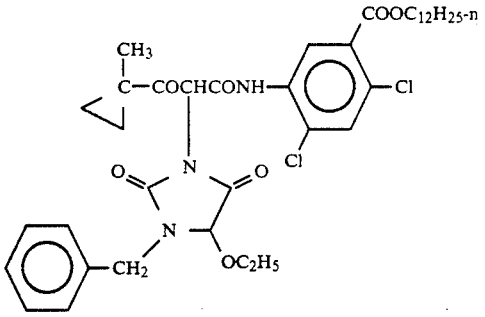
Y-10
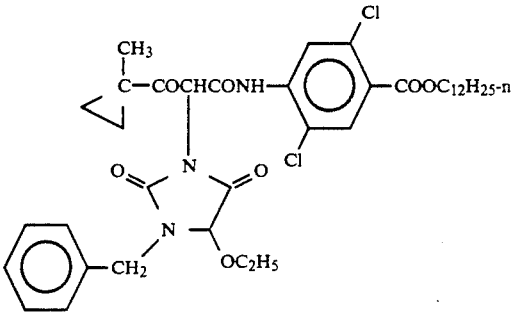
Y-11

-continued
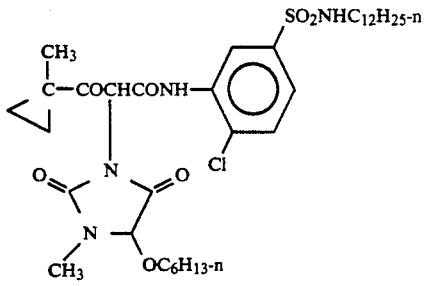
Y-12
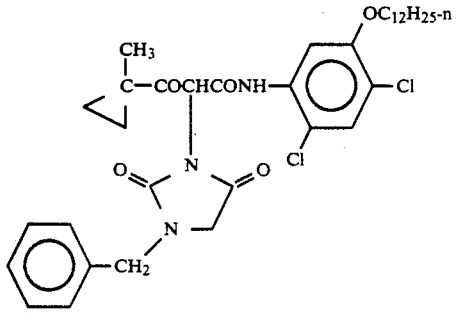
Y-13
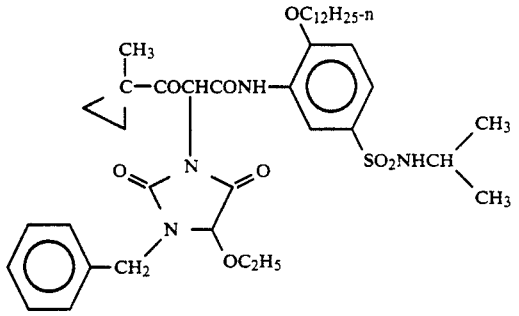
Y-14
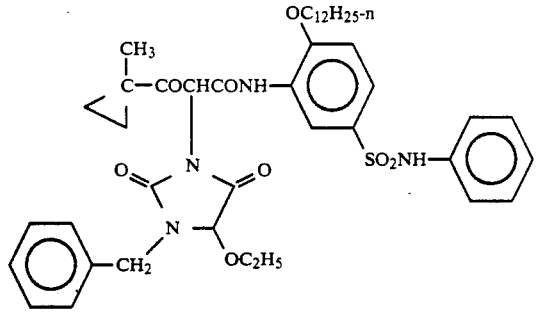
Y-15
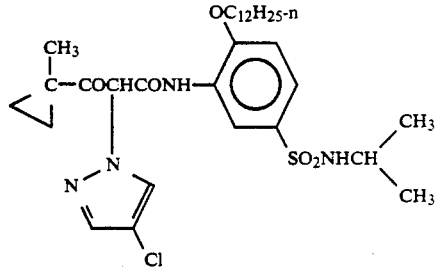
Y-16

-continued
Y-17
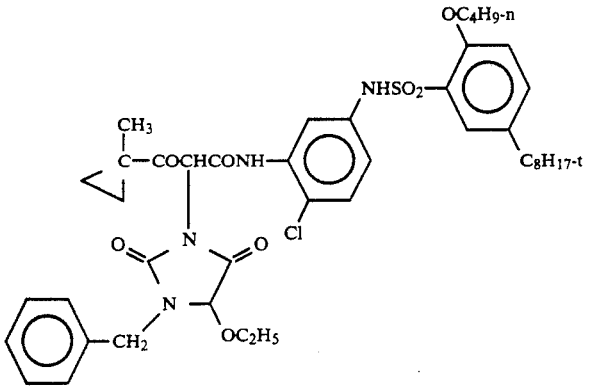
Y-18
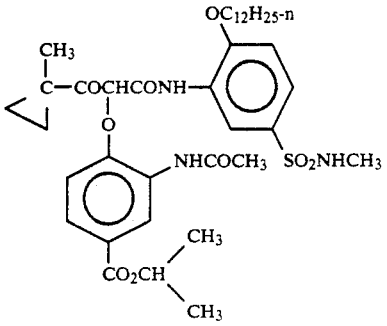
Y-19
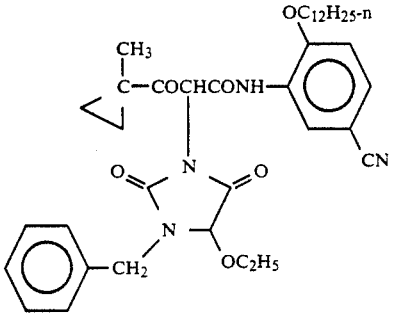
Y-20
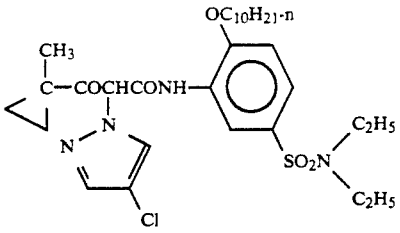
Y-21
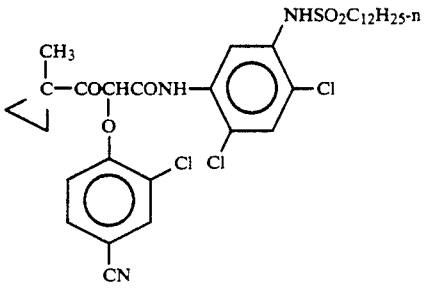

-continued
Y-22
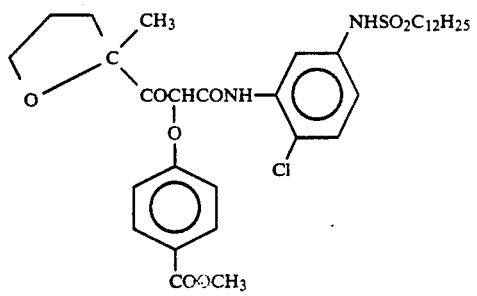
Y-23
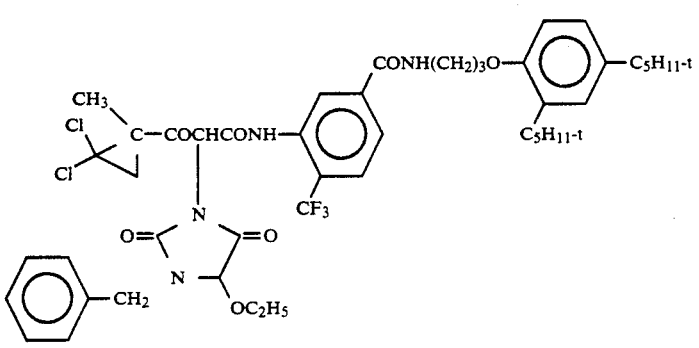
Y-24
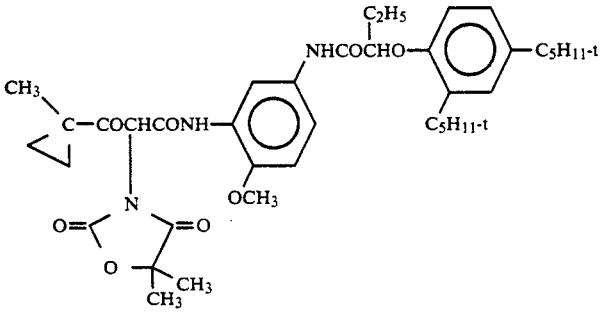
Y-25
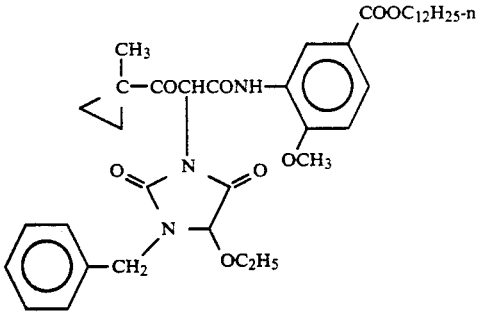
Y-26
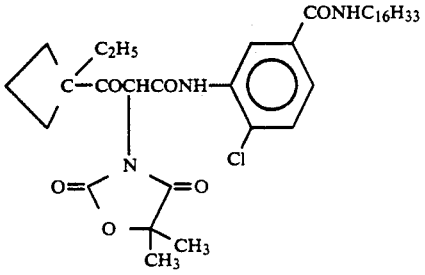

-continued
Y-27
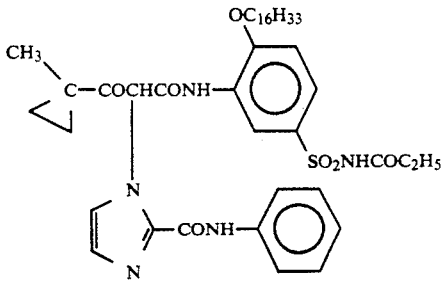
Y-28
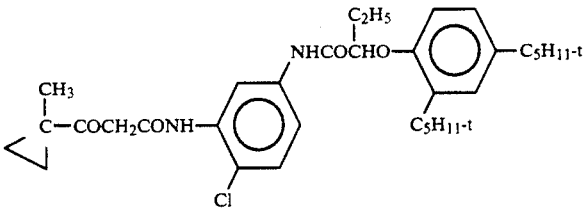
Y-29
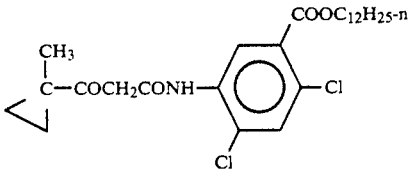
Y-30
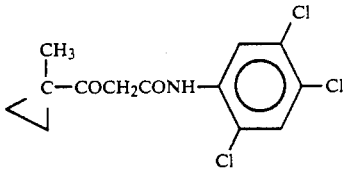
Y-31
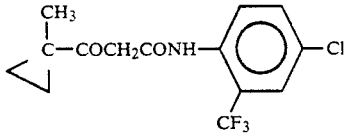
Y-32
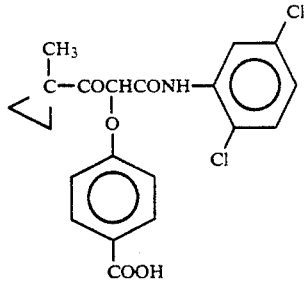
Y-33
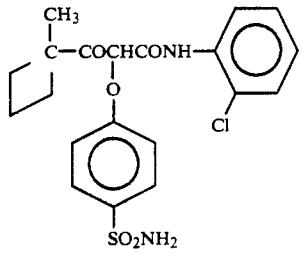

-continued
Y-34
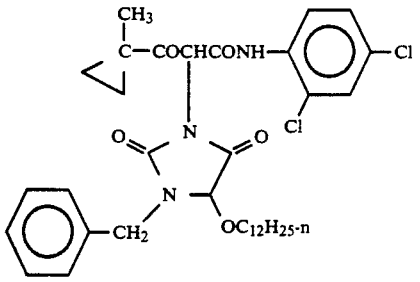
Y-35
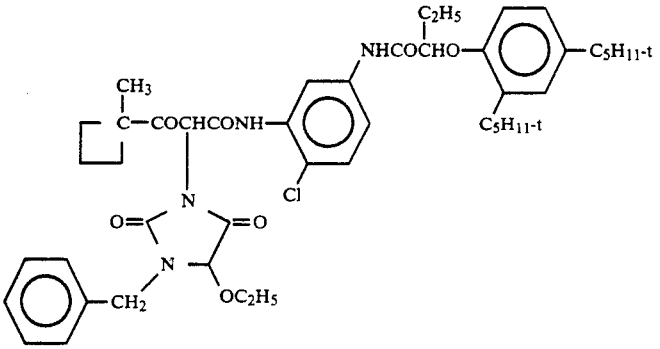
Y-36
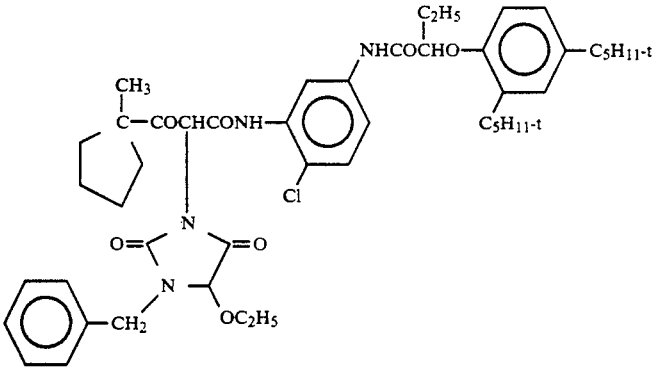
Y-37
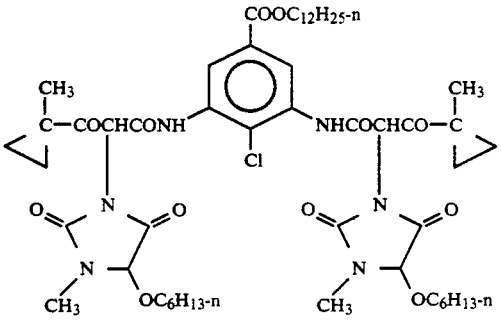

-continued
Y-38
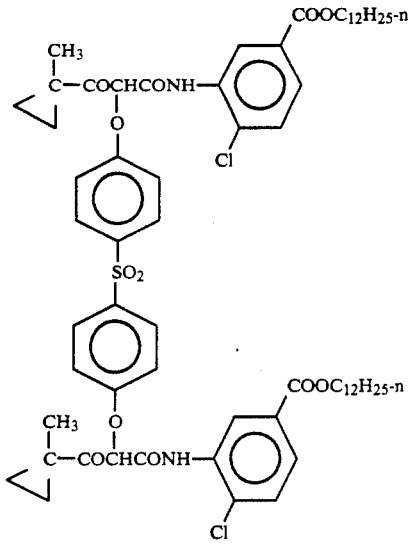
Y-39
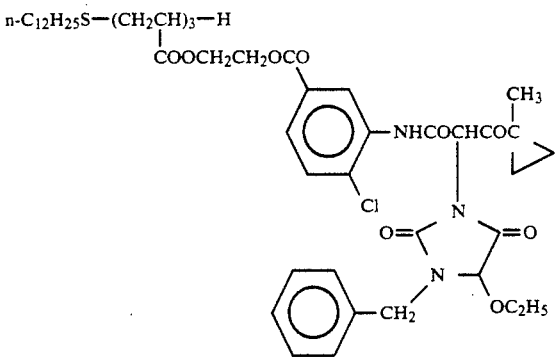
Y-40
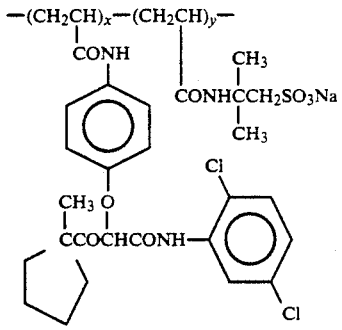
x:y = 80:20 (by weight)
Number average molecular weight 70,000

-continued

Y-41

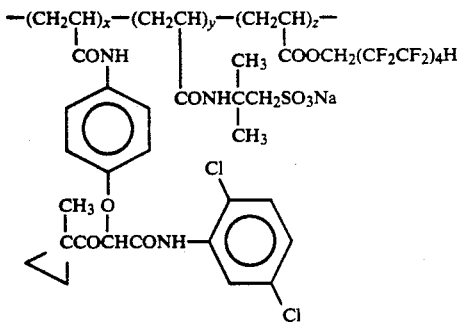

x:y:z = 50:30:20 (by weight)
Number average molecular weight 70,000

Yellow couplers of the present invention which represented by formula [Y] can be prepared using the synthetic route indicated below.

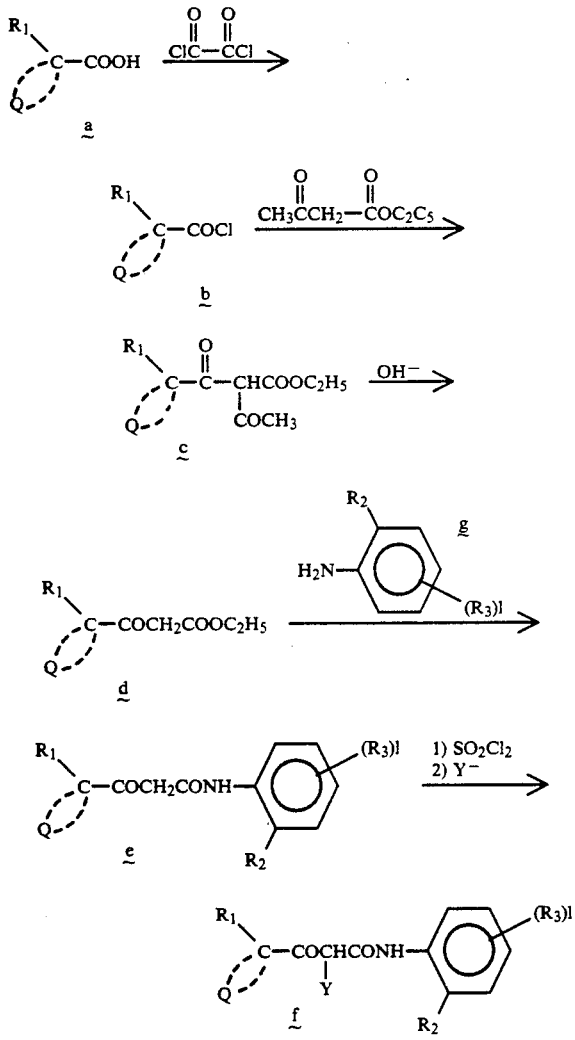

The compound a can be prepared using the methods disclosed, for example, in *J. Chem. Soc. (C)*, 1968, 2548, *J. Am. Chem. Soc.*, 1934, 56, 2710, *Synthesis*, 1971, 258, *J Org. Chem.*, 1978 43, 1729 and CA, 1960, 66, 18533y.

The compounds b, c, d, e and f can be prepared using known methods. Examples of the synthesis of couplers of the present invention are described below.

EXAMPLE OF SYNTHESIS 1: THE PREPARATION OF ILLUSTRATIVE COMPOUND Y-28

Oxalyl chloride (38.1 gram) was drip fed over a period of 30 minutes at room temperature into a mixture comprising 25 grams of 1-methylcyclopropane carboxylic acid which had been prepared using the method disclosed by Gotkis, D., et al., *J. Am. Chem. Soc.*, 1934, 56, 2710, 100 ml of methylene chloride and 1 ml of N,N-dimethylformamide. After the drip feed had been completed the reaction was continued for 2 hours at room temperature and then the methylene chloride and the excess oxalyl chloride were removed under reduced pressure with an aspirator and 1 methylcyclopropanecarbonyl chloride was obtained as an oily substance.

Methanol (100 ml) was drip fed over a period of 30 minutes at room temperature into a mixture comprising 6 grams of magnesium and 2 ml of carbon tetrachloride. After subsequently heating the mixture for 2 hours under reflux, 32.6 grams of ethyl 3-oxobutanoate was added dropwise over a period of 30 minutes while heating under reflux. After the drip feed had been completed, the mixture was heated under reflux for a period of 2 hours and then the methanol was distilled off completely under low pressure using an aspirator. Tetrahydrofuran (100 ml) was added to the mixture and dispersed, and the 1-methylcyclopropanecarbonyl chloride prepared earlier was added dropwise at room temperature. After reacting for a period of 30 minutes, the mixture was extracted with 30 ml of ethyl acetate and dilute aqueous sulfuric acid and, after being washed with water, the organic layer was dried over anhydrous sodium sulfate and then the solvent was removed and 55.3 grams of ethyl 2-(1-methylcyclopropanecarbonyl)-3-oxobutanoate was obtained as an oily substance.

A solution comprising 55 grams of ethyl 2-(1-methylcyclopropanecarbonyl)-3-oxobutanoate and 160 ml of ethanol was stirred at room temperature and 60 ml of a 30% aqueous ammonia solution was added dropwise to this solution over a period of 10 minutes. Subsequently, the mixture was stirred for 1 hour and extracted with 300 ml of ethyl acetate and dilute aqueous hydrochloric acid. After neutralization and washing with water, the organic layer was dried over anhydrous sodium sulfate. The solvent was then removed and 43 grams of ethyl (1-methylcyclopropanecarbonyl)acetate was obtained as an oily material.

Ethyl (1-methylcyclopropanecarbonyl)acetate (34 grams) and 44.5 grams of N-(3-amino-4-chlorophenyl)-2-(2,4-di-tert-pentylphenoxy)butanamide were heated under reflux at an internal temperature from 100° C. to 120° C. under reduced pressure using an aspirator. After reacting for 4 hours, the reaction mixture was refined using column chromatography with an n-hexane/ethyl acetate mixed solvent and 49 grams of illustrative compound Y-28 were obtained as a sticky oily material. The structure of the compound was confirmed by MS spectroscopy, NMR spectroscopy and elemental analysis.

EXAMPLE OF SYNTHESIS 2 : THE PREPARATION OF ILLUSTRATIVE COMPOUND Y-1

Illustrative compound Y-28 (22.8 grams) was dissolved in 300 ml of methylene chloride and 5.4 grams of sulfuryl chloride was added dropwise over a period of 10 minutes with ice cooling. After reacting for 30 minutes, the reaction mixture was washed thoroughly with water and dried over anhydrous sodium sulfate and then concentrated whereupon the chloride of illustrative compound Y-28 was obtained. The chloride of illustrative compound Y-28 which had been prepared beforehand was dissolved in 50 ml of N,N-dimethylformaldehyde and added dropwise at room temperature over a period of 30 minutes to a solution of 18.7 grams of 1-benzyl-5-ethoxyhydantoin, 11.2 ml of triethylamine and 50 ml of N,N-dimethylformamide.

Subsequently, after reacting for 4 hours at 40° C., the reaction mixture was extracted with 300 ml of ethyl acetate and, after washing with water, the extract was washed with 300 ml of 2% aqueous triethylamine solution and then it was neutralized with dilute hydrochloric acid. The organic layer was dried over anhydrous sodium sulfate and then the solvent was distilled off and the oily material which was obtained was crystallized from an n-hexane/ethyl acetate mixed solvent. The crystals which precipitated out were recovered by filtration and, after washing with n-hexane/ethyl acetate mixed solvent, the crystals were dried and 22.8 grams of crystals of illustrative compound Y-1 were obtained.

The structure of this compound was confirmed by MS spectrosropy, NMR spectroscopy and elemental analysis. Furthermore, the melting point was 132–133° C.

The yellow couplers of the present invention may be used independently, or mixtures of two or more types can be used conjointly, and they can also be used in the form of mixtures with known yellow couplers.

The yellow couplers of the present invention can be used in a blue sensitive silver halide emulsion layer or a layer adjacent thereto, and they are desirably used in a blue sensitive silver halide emulsion layer.

The amount of yellow coupler of the present invention used in a photographic material is from $1\times10^{-5}$ to $1\times10^{-2}$ mol, preferably from $1\times10^{-4}$ to $5\times10^{-3}$ mol, and most desirably from $2\times10^{-4}$ to $2\times10^{-3}$ mol, per square meter.

The couplers represented by formula [M] are described in detail below.

$R_{20}$ represents a hydrogen atom or a substituent group which is the same as $R_{21}$ in formulae [M-I], [M-II], [M-III] and [M-IV] described below.

Z represents a group of non-metal atom which is required to form a five membered azole ring which contains 2 to 4 nitrogen atoms. Z preferably represents a triazole ring.

X represents a hydrogen atom or a coupling-off group (a group which can be eliminated at the time of coupling reaction with the oxidized form of a developing agent), which is the same as X in formulae [M-I], [M-II], [M-III] and [M-IV] described below.

The preferred skeleton from among the coupler skeletons are 1H-imidazo[1,2-b]pyrazole, 1H-pyrazolo[1,5-b][1,2,4]triazole, 1H-pyrazolo[5,1-c][1,2,4]triazole and 1H-pyrazolo[1,5-d]tetrazole, and these can be presented by formulae [M-I], [M-II], [M-III] and [M-IV].

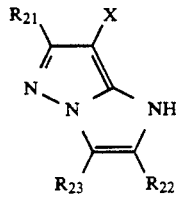
[M-I]

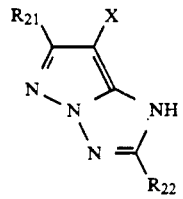
[M-II]

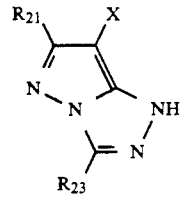
[M-III]

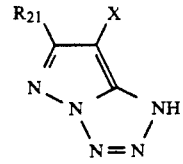
[M-IV]

The substituent groups $R_{21}$, $R_{22}$, $R_{23}$ and X in these formulae are described in detail below.

$R_{21}$ represents a hydrogen atom, a halogen atom, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and dimers may be formed with $R_{21}$ as a divalent group.

More precisely, the $R_{21}$ groups each represent a hydrogen atom, a halogen atom (for example, chlorine, bromine), an alkyl group (for example, a linear chain or branched chain alkyl group, aralkyl group, alkenyl group, alkynyl group, cycloalkyl group or cycloalkenyl group which has from 1 to 32 carbon atoms and, more precisely, for example, methyl, ethyl, propyl, isopropyl, tert-butyl, tridecyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, 3-(2,4-di-tert-amylphenoxy)propyl), an aryl group (for example, phenyl, 4-tert-butylphenyl, 2,4-di-tert-amylphenyl, 4-tetradecanamido-phenyl), a heterocyclic group (for example, 2-furyl, 2-thienyl, 2-pyrimidinyl, 2-benzothiazolyl), a cyano group, a hydroxy group, a nitro group, a carboxy group, an amino group, an alkoxy group (for example, methoxy, ethoxy, 2-methoxyethoxy, 2-dodecyl-ethoxy, 2-methanesulfonylethoxy), an aryloxy group (for example, phenoxy, 2-methylphenoxy, 4-tert-butylphenoxy, 3-nitrophenoxy, 3-tert-butyloxycarbamoylphenoxy, 3-methoxycarbamoyl), an acylamino group (for example, acetamido, benzamido, tetradecanamido, 2-(2,4-di-tert-amylphenoxy)-butanamido, 4-(3-tert-butyl-4-hydroxyphenoxy)-butanamido, 2-{4-(4-hydroxyphenylsulfonyl)phenoxy}decanamido), an alkylamino group (for example, methylamino, butylamino, dodecylamino, diethylamino, methylbutylamino), an anilino group (for example, phenylamino, 2-chloroanilino, 2-chloro-5-tetradecanaminoanilino, 2-chloro-5-dodecyloxycarbonylanilino, N-acetylanilino, 2-chloro-5-{α-(3-tert-butyl-4-hydroxyphenoxy)dodecanamido]-anilino), a ureido group (for example, phenylureido, methylureido, N,N-dibutylureido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propylthio), an arylthio group (for example, phenylthio, 2-butoxy-5-tert-octylphenylthio, 3-pentadecylphenylthio, 2-carboxyphenylthio, 4-tetradecanamidophenylthio), an alkoxycarbonylamino group (for example, methoxycarbonylamino, tetradecyloxycarbonylamino), a sulfonamido group (for example, methanesulfonamido, hexadecane-sulfonamido, benzenesulfonamido, p-toluenesulfonamido, octadecanesulfonamido, 2-methyloxy-5-tert-butylbenzene-sulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy)propyl}-carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl), an alkoxycarbonyl group (for example, methoxycarbonyl, butyloxycarbonyl, dodecyloxycarbonyl, octadecyloxycarbonyl), a heterocyclic oxy group (for example, 1-phenyltetrazole-5-oxy, 2-tetrahydropyranyloxy), an azo group (for example, phenylazo, 4-methoxyphenylazo, 4-pivaloylamino-phenylazo, 2-hydroxy-4-propanoylphenylazo), an acyloxy group (for example, acetoxy), a carbamoyloxy group (for example, N-methylcarbamoyloxy, N-phenylcarbamoyloxy), a silyloxy group (for example, trimethylsilyloxy, dibutylmethylsilyloxy), an aryloxycarbonylamino group (for example, phenoxycarbonylamino), an imido group (for example, N-succinimido, N-phthalimido, 3-octadecenylsuccinimido), a heterocyclic thio group (for example, 2-benzothiazolylthio, 2,4-di-phenoxy-1,3,5-triazolyl-6-thio, 2-pyridylthio), a sulfinyl group (for example, dodecanesulfinyl, 3-pentadecylphenylsulfinyl, 3-phenoxypropylsulfinyl), a phosphonyl group (for example, phenoxyphosphonyl, octyloxyphosphonyl, phenylphosphonyl), an aryloxycarbonyl group (for example, phenoxycarbonyl), an acyl group (for example, acetyl, 3-phenylpropanoyl, benzoyl, 4-dodecyloxobenzoyl) or an azolyl group (for example, imidazolyl, pyrazolyl, 3-chloropyrazol-1-yl, triazolyl). Those of these substituent groups which can have further substituent groups may have organic substituent groups or halogen atoms bonded to a carbon atom, an oxygen atom, a nitrogen atom or a sulfur atom.

From among these substituent groups, the alkyl groups, aryl groups, alkoxy groups, aryloxy groups, alkylthio groups, ureido groups, urethane groups and acylamino groups are preferred for $R_{21}$.

$R_{22}$ is a group which is the same as the substituent groups described in connection with $R_{21}$, and it is preferably a hydrogen atom, an alkyl group, an aryl group, a heterocyclic group, an alkoxycarbonyl group, a carbamoyl group, a sulfamoyl group, a sulfinyl group, an acyl group or a cyano group.

Furthermore, $R_{23}$ is a group which is the same as the substituent groups described in connection with $R_{21}$, and it is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, and it is most desirably an alkyl group, an aryl group, a heterocyclic group, an alkylthio group or an arylthio group.

X represents a hydrogen atom or a coupling-off group (a group which can be eliminated in a reaction with the oxidized form of a primary aromatic amine color developing agent) and more precisely the coupling-off group is, for example, a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a five or six membered nitrogen containing heterocyclic group, an imido group or an arylazo group, and these groups may be further substituted with the groups which are permitted as substituent groups for $R_{21}$.

More precisely, these groups include halogen atoms (for example, fluorine, chlorine, bromine), alkoxy groups (for example, ethoxy, dodecyloxy, methoxyethylcarbamoylmethoxy, carboxypropyloxy, methylsulfonylethoxy, ethoxycarbonylmethoxy), aryloxy groups (for example, 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), acyloxy groups (for example, acetoxy, tetradecanoyloxy, benzoyloxy), alkyl or aryl sulfonyloxy groups (for example, methanesulfonyloxy, toluene-sulfonyloxy), acylamino groups (for example, dichloroacetylamino, pentafluorobutyrylamino), alkyl or aryl sulfonamido groups (for example, methanesulfonamino, trifluoromethanesulfonamino, p-toluenesulfonamino), alkoxycarbonyloxy groups (for example, ethoxycarbonyloxy, benzyloxycarbonyloxy), aryloxycarbonyloxy groups (for example, phenoxycarbonyloxy), alkyl, aryl or heterocyclic thio groups (for example, dodecylthio, 1-carboxydodecylthio, phenylthio, 2-butoxy-5-tert-octylphenylthio, tetrazolylthio), carbamoylamino groups (for example, N-methylcarbamoylamino, N-phenylcarbamoylamino), five or six membered nitrogen containing heterocyclic groups (for example, imidazolyl, pyrazolyl, triazolyl, tetrazolyl, 1,2-dihydro-2-oxo-1-pyridyl), imido groups (for example, succinimido, hydantoinyl) and arylazo group (for example, phenylazo, 4-methoxyphenylazo). There are also cases in which the form of a dimeric coupler for which four equivalent couplers are condensed with an aldehyde or a ketone with X as a coupling-off group which is bonded via a carbon atom is adopted rather than these forms. Furthermore, X may contain a photographically useful group such as a development inhibitor or a development accelerator. X is preferably a halogen atom, an alkoxy group, an aryloxy group, an alkyl or aryl thio group or a five or six membered nitrogen containing heterocyclic group which is bonded to the coupling position via a nitrogen atom.

Of the magenta couplers represented by the formulae [M-I], [M-II], [M-III] and [M-IV], the couplers represented by the formula [M-II] or [M-III] are preferred.

Illustrative examples of magenta couplers which can be represented by the formula [M] are indicated below, but these compounds are not limited to these examples.

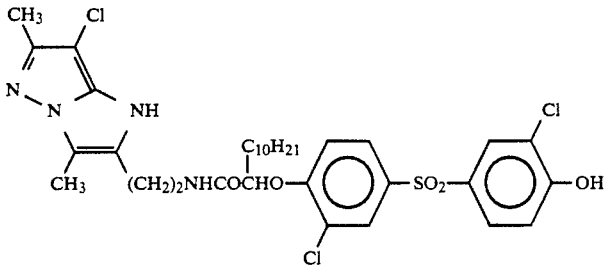
(M-1)

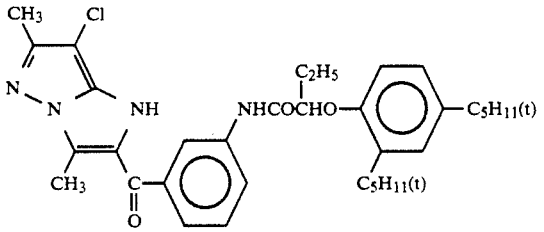
(M-2)

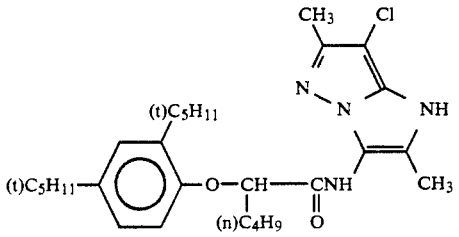
(M-3)

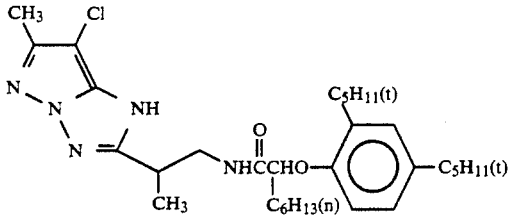
(M-4)

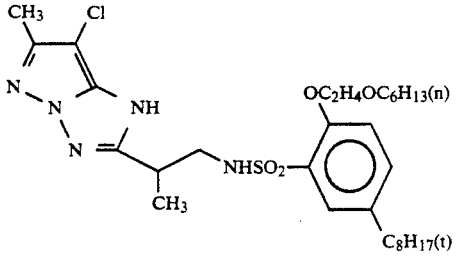
(M-5)

-continued
(M-6)
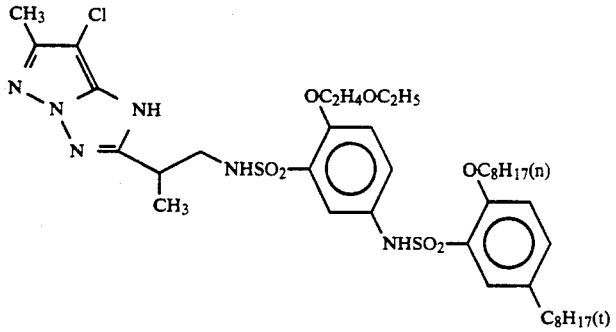
(M-7)
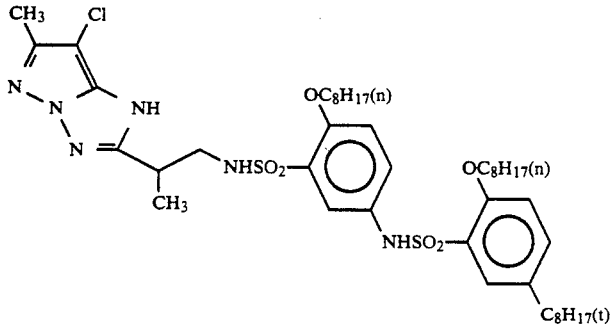
(M-8)
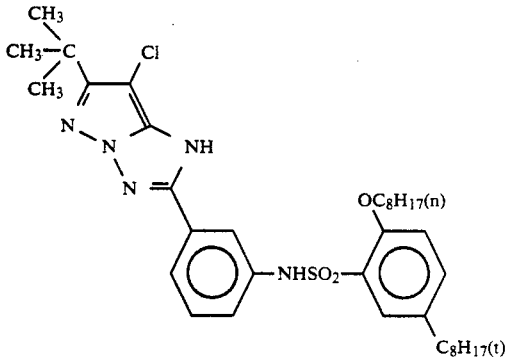
(M-9)
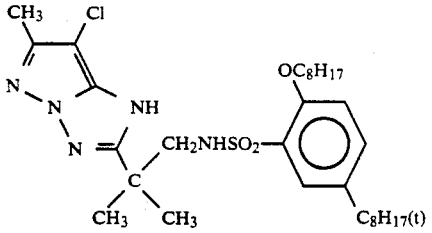
(M-10)
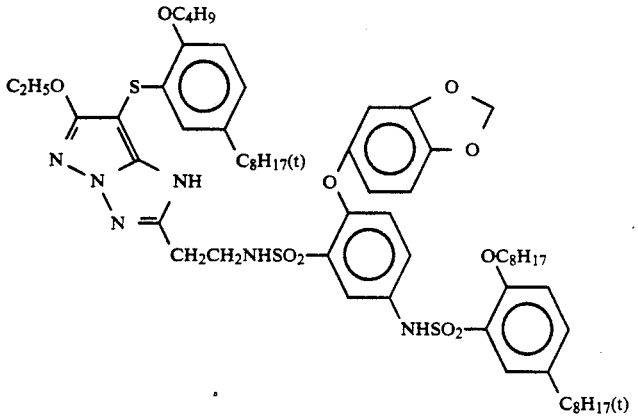

-continued
(M-11)
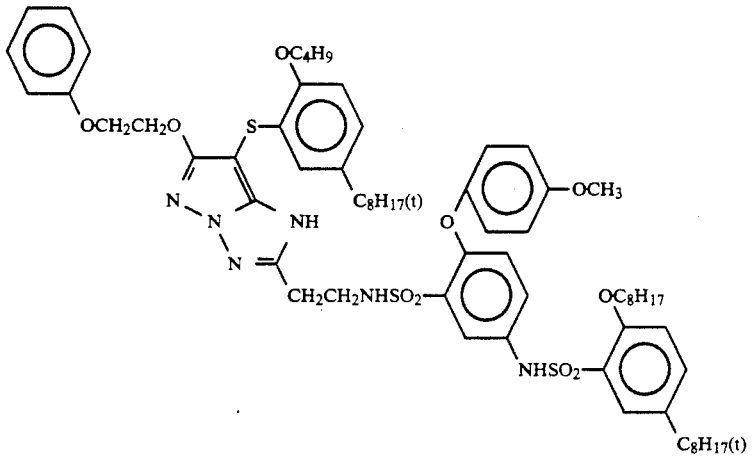
(M-12)
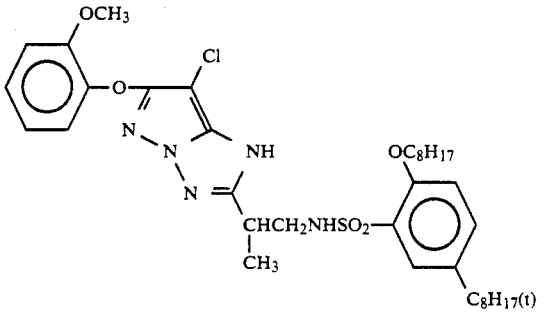
(M-13)
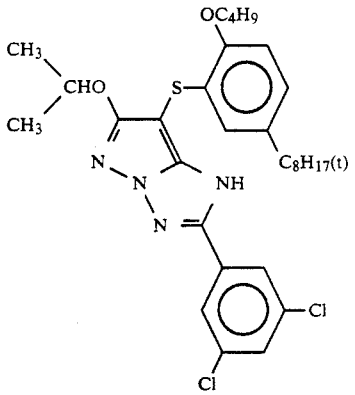
(M-14)
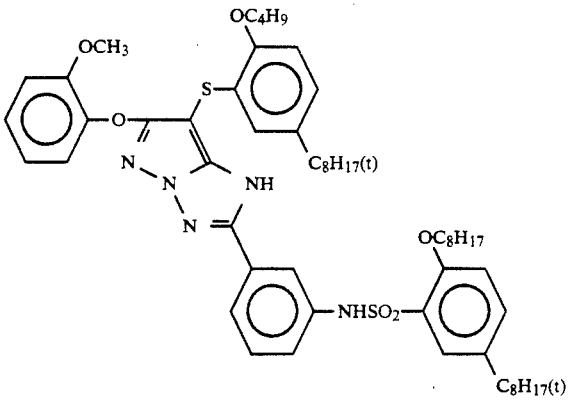

-continued
(M-15)
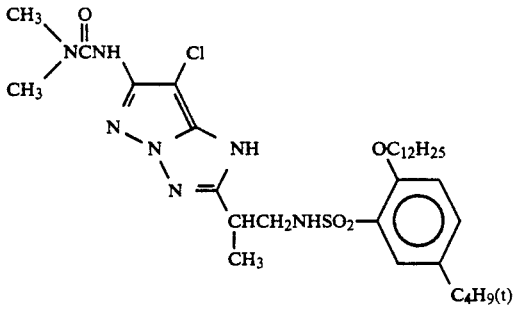
(M-16)
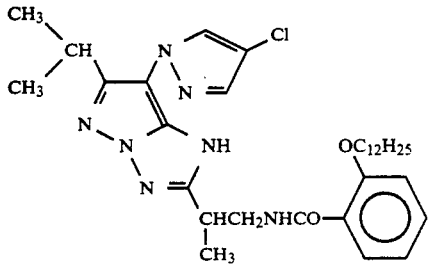
(M-17)
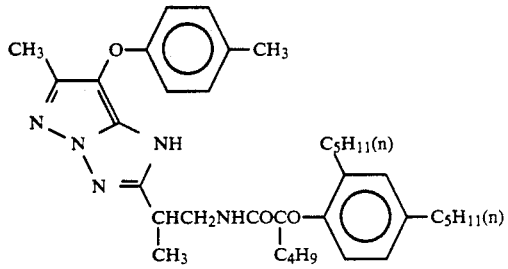
(M-18)
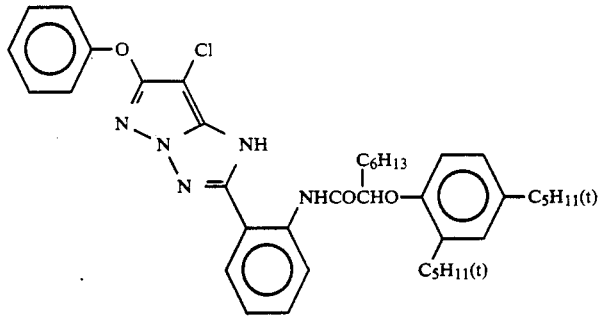
(M-19)
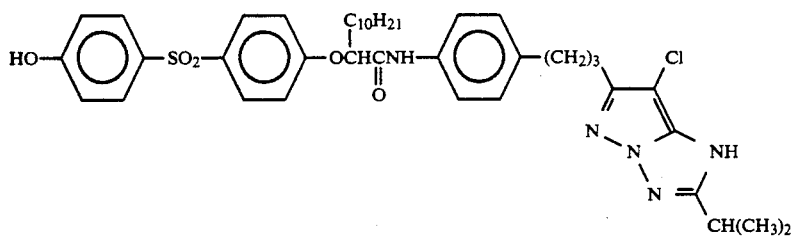

-continued
(M-20)
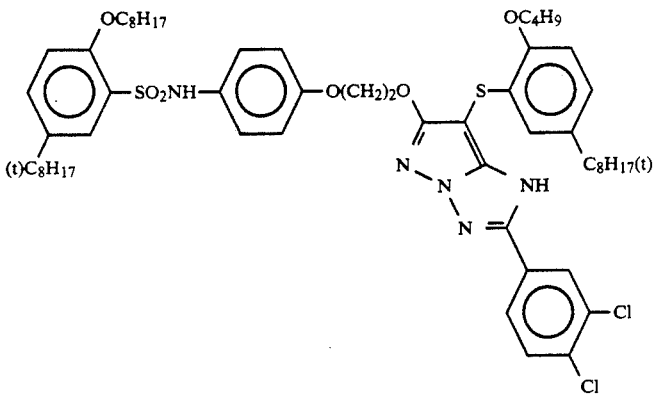
(M-21)
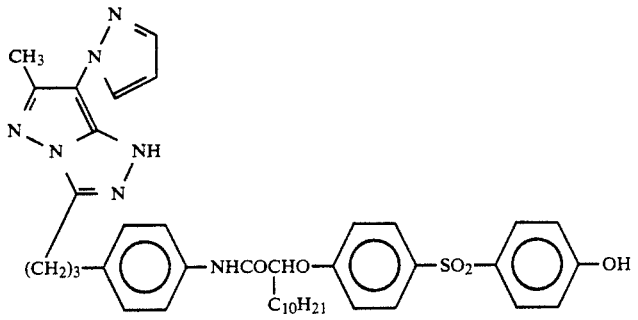
(M-22)
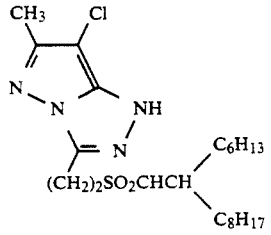
(M-23)
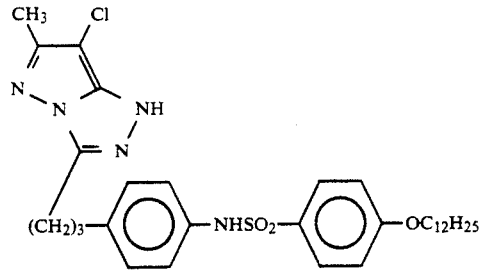
(M-24)
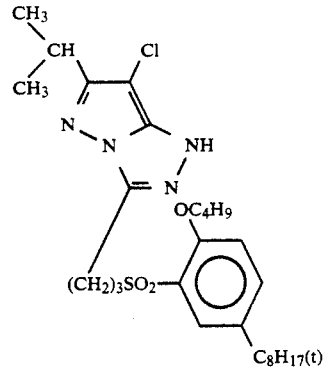

-continued
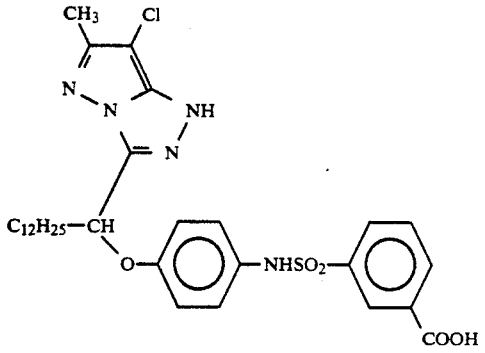
(M-25)
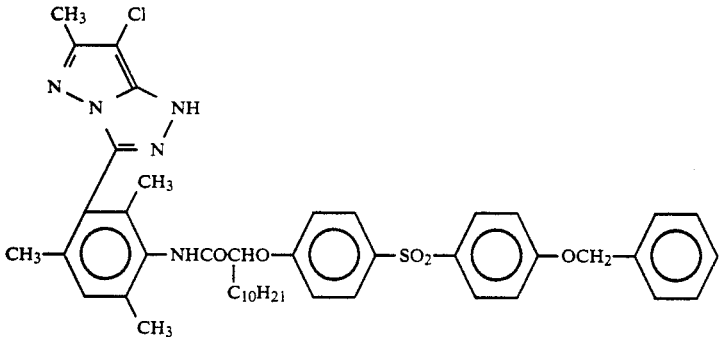
(M-26)
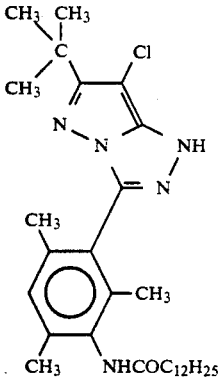
(M-27)
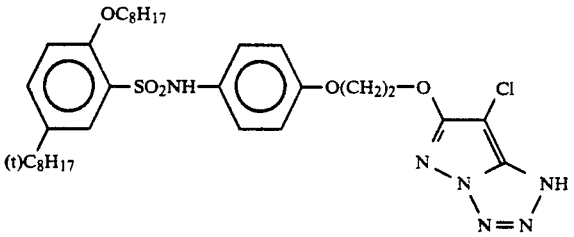
(M-28)

-continued (M-29)

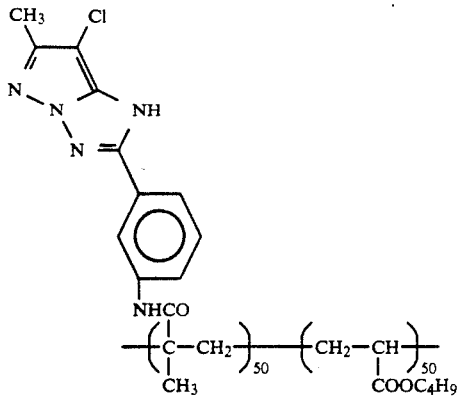

Numbers indicate wt%

(M-30)

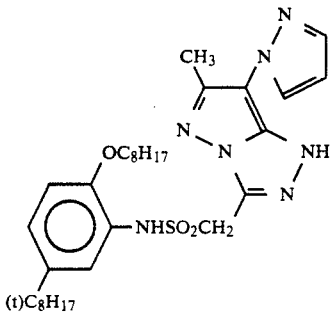

(M-31)

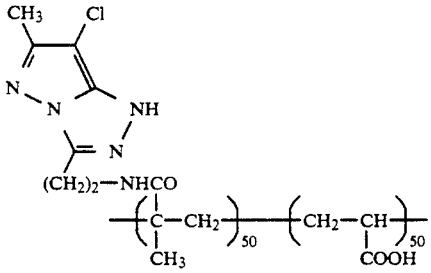

Numbers indicate wt%

Literature in which methods for the preparation of couplers which can be represented by formula [M] have been disclosed is indicated below.

Compounds of formula [M-I] can be prepared using the method disclosed, for example, in U.S. Pat. No. 4,500,630. Compounds of formula [M-II] can be prepared using the methods disclosed, for example, in U.S. Pat. Nos. 4,540,654 and 4,705,863, JP-A-61-65245, JP-A-62-209457 and JP-A-62-249155. Compounds of formula [M-III] can be prepared using the methods disclosed, for example, in JP-B-47-27411 and U.S. Pat. No. 3,725,067. Compounds of formula [M-IV] can be prepared using the methods disclosed, for example, in JP-A-60-33552. (The term "JP-B" as used herein signifies an "examined Japanese patent publication".)

The layers in which the couplers represented by formula [M] of the present invention are added are preferably green sensitive emulsion layers or non-photosensitive intermediate layers which are adjacent thereto. Furthermore, the couplers represented by formula [M] are preferably used in the form of mixtures provided that there is no loss of the effect of the invention. The couplers of formula [M] are generally used in amounts from 0.01 mmol to 1 mmol, and preferably in amounts from 0.1 mmol to 0.5 mmol, per square meter of photographic material.

The various additives aforementioned can be used in a photographic materials which involves the present technique, but various other additives can also be used for various purposes.

These additives have been disclosed in more detail in *Research Disclosure* Item 17643 (December 1978) and *Research Disclosure* Item 18716 (November 1979), and the locations of said disclosures are indicated in the following Table.

| | Type of Additives | RD 17643 | RD 18716 |
|---|---|---|---|
| 1. | Chemical Sensitizers | Page 23 | Page 648, right column |
| 2. | Speed Increasing Agents | | As above |
| 3. | Spectral Sensitizers and Supersensitizers | Pages 23 to 24 | Page 648, right column to page 649, right column |
| 4. | Whiteners | Page 24 | |
| 5. | Antifoggants and Stabilizers | Pages 24 to 25 | Page 649, right column |
| 6. | Light-Absorbers, Filter Dyes and UV Absorbers | Pages 25 to 26 | Page 649, right column to page 650, left column |

-continued

| | Type of Additives | RD 17643 | RD 18716 |
|---|---|---|---|
| 7. | Antistaining Agents | Page 25, right column | Page 650, left-right column |
| 8. | Dye Image Stabilizers | Page 25 | |
| 9. | Film Hardening Agents | Page 26 | Page 651, left column |
| 10. | Binders | Page 26 | As above |
| 11. | Plasticizers, Lubricants | Page 27 | Page 650, right column |
| 12. | Coating aids, Surfactants | Pages 26 to 27 | Page 650, right column |
| 13. | Antistatic Agents | Page 27 | As above |

Furthermore, addition of the compounds which can react with and fix formaldehyde disclosed in U.S. Pat. Nos. 4,411,987 and 4,435,503 to the photographic material is desirable for preventing the deterioration of photographic performance due to formaldehyde gas.

The addition to a color photographic material of the present invention of various fungicides and biocides such as 1,2-benzisothiazolin-3-one, n-butyl p-hydroxybenzoate, phenol, 4-chloro-3,5-dimethylphenol, 2-phenoxyethanol and 2-(4-thiazolyl)benzimidazole, for example, as disclosed in JP-A-63-257747, JP-A-62-272248 and JP-A-1-80941, is desirable.

Suitable supports which can be used in the present invention have been disclosed, for example, on page 28 of the aforementioned *Research Disclosure* No. 17643, and from the right hand column of page 647 to the left hand column of page 648 of *Research Disclosure* No. 18716.

The photographic materials in which photographic emulsions of the present invention are used are such that the total film thickness of all the hydrophilic colloid layers on the side where the emulsion layers are located is preferably not more than 28 μm, more desirably not more than 23 μm, and most desirably not more than 20 μm. Furthermore, the film swelling rate $T_{\frac{1}{2}}$ is preferably not more than 30 seconds and most desirably not more than 20 seconds. Here, the film thickness signifies the film thickness measured under conditions of 25° C., 55% relative humidity (2 days) and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129. $T_{\frac{1}{2}}$ is defined as the time taken to reach half the saturated film thickness, taking 90% of the maximum swollen film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the aging conditions after coating. Furthermore, the swelling factor is preferably from 150% to 400%. The swelling factor can be calculated from the maximum swollen film thickness obtained under the conditions described above using the expression (maximum swollen film thickness minus film thickness)/film thickness.

Color photographic materials which are in accordance with the present invention can be developed and processed using the usual methods disclosed on pages 28–29 of the aforementioned *Research Disclosure* No. 17643 and from the left hand column to the right hand column of page 651 of the aforementioned *Research Disclosure* No. 18716.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black and white developer.

The silver halide color photographic materials in which photographic emulsions of the invention have been used are generally subjected to a water washing process and/or stabilization process after the desilvering process. The amount of wash water used in the washing process can be fixed within a wide range, depending on the application and the nature (the materials such as couplers which have been used for example) of the photographic material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers*, Volume 64 (May 1955).

The amount of wash water used can be greatly reduced by using the multi-stage counter-flow system noted in the aforementioned literature, but bacteria proliferate due to the increased residence time of the water in the tanks and problems arise with the suspended matter which is produced becoming attached to the photographic material. The method in which the calcium ion and magnesium ion concentrations are reduced, as disclosed in JP-A-62-288388, is very effective as a means of overcoming this problem when processing color photographic materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sankyo Shuppan), in *Killing Microorganisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photographic materials of the present invention is from 4 to 9, and preferably from 5 to 8. The washing water temperature and the washing time can be set variously in accordance with the characteristics and application of the photographic material but, in general, washing conditions from 20 seconds to 10 minutes at a temperature from 15° C. to 45° C., and preferably from 30 seconds to 5 minutes at a temperature from 25° C. to 40° C., are selected. Moreover, the photographic materials of this invention can be processed directly in a stabilizing bath instead of being subjected to a water wash as described above. The known methods disclosed in JP-A-57-8543, JP-A-58-14834 and JP-A-60-220345 can all be used for a stabilization process of this type.

Furthermore, these are also cases in which a stabilization process is carried out following the aforementioned water washing process, and the formalin baths which are used as final baths with camera color photographic materials are an example of such a process.

ILLUSTRATIVE EXAMPLES

The invention is described in practical terms below by means of illustrative examples, bu the invention is not limited by these examples. Unless otherwise indicated, all parts, percents, ratios and the like are by weight.

EXAMPLE 1

Preparation of Sample 101

A multi-layer color photographic material comprising the following layers containing the compositions indicated below was prepared on a cellulose triacetate film support having a thickness of 127 μm on which a subbing layer had been established, and this was taken as sample 101. The numbers indicate the amounts added per square meter. Moreover, the effect of the compounds added is not limited to application disclosed.

| | |
|---|---|
| First Layer Anti-halation Layer | |
| Black colloidal silver | 0.25 gram |
| Gelatin | 1.9 grams |
| Ultraviolet absorber U-1 | 0.04 gram |
| Ultraviolet absorber U-2 | 0.1 gram |
| Ultraviolet absorber U-3 | 0.1 gram |
| Ultraviolet absorber U-4 | 0.1 gram |
| Ultraviolet absorber U-6 | 0.1 gram |
| High boiling point organic solvent Oil-1 | 0.1 gram |
| Second Layer Intermediate Layer | |
| Gelatin | 0.40 gram |
| Compound Cpd-D | 10 mg |
| High boiling point organic solvent Oil-3 | 0.1 gram |
| Dye D-4 | 0.4 mg |
| Third Layer Intermediate Layer | |
| A fine grain silver iodobromide emulsion in which the surface and interior had been fogged (average gain size 0.06 μm, variation coefficient 18%, AgI content 1 mol %) | 0.05 gram as silver |
| Gelatin | 0.4 gram |
| Fourth Layer Low Speed Red Sensitive Emulsion Layer | |
| Emulsion A | as silver 0.2 gram |
| Emulsion B | as silver 0.3 gram |
| Gelatin | 0.8 gram |
| Coupler C-1 | 0.15 gram |
| Coupler C-2 | 0.05 gram |
| Coupler C-9 | 0.05 gram |
| Compound Cpd-D | 10 mg |
| High boiling point organic solvent Oil-2 | 0.1 gram |
| Fifth Layer Medium Speed Red Sensitive Emulsion Layer | |
| Emulsion B | as silver 0.2 gram |
| Emulsion C | as silver 0.3 gram |
| Gelatin | 0.8 gram |
| Coupler C-1 | 0.2 gram |
| Coupler C-2 | 0.05 gram |
| Coupler C-3 | 0.2 gram |
| High boiling point organic solvent Oil-2 | 0.1 gram |
| Sixth Layer High Speed Red Sensitive Emulsion Layer | |
| Emulsion D | as silver 0.4 gram |
| Gelatin | 1.1 grams |
| Coupler C-1 | 0.3 gram |
| Coupler C-3 | 0.7 gram |
| Additive P-1 | 0.1 gram |
| Seventh Layer Intermediate Layer | |
| Gelatin | 0.6 gram |
| Compound M-1 | 0.3 gram |
| Anti-color mixing agent Cpd-K | 2.6 mg |
| Ultraviolet absorber U-1 | 0.1 gram |
| Ultraviolet absorber U-6 | 0.1 gram |
| Dye D-1 | 0.02 gram |
| Eighth Layer Intermediate Layer | |
| A fine grain silver iodobromide emulsion in which the surface and interior had been fogged (average grain size 0.06 μm, variation coefficient 16%, AgI content 0.3 mol %) | 0.02 gram as silver |
| Gelatin | 1.0 gram |
| Anti-color mixing agent Cpd-L | 0.2 gram |
| Ninth Layer Low Speed Green Sensitive Emulsion Layer | |
| Emulsion E | as silver 0.3 gram |
| Emulsion F | as silver 0.1 gram |
| Emulsion G | as silver 0.1 gram |
| Gelatin | 0.5 gram |
| Coupler C-4 | 0.25 gram |
| Compound Cpd-B | 0.03 gram |
| Compound Cpd-D | 10 mg |
| Compound Cpd-E | 0.02 gram |
| Compound Cpd-F | 0.02 gram |
| Compound Cpd-G | 0.02 gram |
| Compound Cpd-H | 0.02 gram |
| High boiling point organic solvent Oil-1 | 0.1 gram |
| High boiling point organic solvent Oil-2 | 0.1 gram |
| Tenth Layer Medium Speed Green Sensitive Emulsion Layer | |
| Emulsion G | as silver 0.3 gram |
| Emulsion H | as silver 0.1 gram |
| Gelatin | 0.6 gram |
| Coupler C-4 | 0.25 gram |
| Compound Cpd-B | 0.03 gram |
| Compound Cpd-E | 0.02 gram |
| Compound Cpd-F | 0.02 gram |
| Compound Cpd-G | 0.05 gram |
| Compound Cpd-H | 0.05 gram |
| High boiling point organic solvent Oil-2 | 0.01 gram |
| Eleventh Layer High Speed Green Sensitive Emulsion Layer | |
| Emulsion I | as silver 0.5 gram |
| Gelatin | 1.0 gram |
| Coupler C-4 | 0.35 gram |
| Compound Cpd-B | 0.08 gram |
| Compound Cpd-E | 0.02 gram |
| Compound Cpd-F | 0.02 gram |
| Compound Cpd-G | 0.02 gram |
| Compound Cpd-H | 0.02 gram |
| High boiling point organic solvent Oil-1 | 0.02 gram |
| High boiling point organic solvent Oil-2 | 0.02 gram |
| Twelfth Layer Intermediate Layer | |
| Gelatin | 0.6 gram |
| Dye D-1 | 0.1 gram |
| Dye D 2 | 0.05 gram |
| Dye D-3 | 0.07 gram |
| Thirteenth Layer Yellow Filter Layer | |
| Yellow colloidal silver | as silver 0.1 gram |
| Gelatin | 1.1 gram |
| Anti-color mixing agent Cpd-A | 0.01 gram |
| High boiling point organic solvent Oil-1 | 0.01 gram |
| Fourteenth Layer Intermediate Layer | |
| Gelatin | 0.6 gram |
| Fifteenth Layer Low Speed Blue Sensitive Emulsion Layer | |
| Emulsion J | as silver 0.4 gram |
| Emulsion K | as silver 0.1 gram |
| Emulsion L | as silver 0.1 gram |
| Gelatin | 0.8 gram |
| Coupler C-5 | 0.6 gram |
| Sixteenth layer Medium Speed Blue Sensitive Emulsion Layer | |
| Emulsion L | as silver 0.1 gram |
| Emulsion M | as silver 0.4 gram |
| Coupler C-5 | 0.6 gram |
| Seventeenth Layer High Speed Blue Sensitive Emulsion Layer | |
| Emulsion N | as silver 0.4 gram |
| Gelatin | 1.2 grams |
| Coupler C-5 | 0.7 gram |
| Eighteenth Layer First Protective Layer | |
| Gelatin | 0.7 gram |
| Ultraviolet absorber U-1 | 0.04 gram |
| Ultraviolet absorber U-2 | 0.01 gram |
| Ultraviolet absorber U-3 | 0.03 gram |
| Ultraviolet absorber U-4 | 0.03 gram |

-continued

| | |
|---|---|
| Ultraviolet absorber U-5 | 0.05 gram |
| Ultraviolet absorber U-6 | 0.05 gram |
| High boiling point organic solvent Oil-1 | 0.02 gram |
| Formalin scavengers | |
| pd-C | 0.2 gram |
| Cpd-1 | 0.4 gram |
| Dye D-3 | 0.05 gram |
| Nineteenth Layer Second Protective Layer | |
| Colloidal silver | as silver 0.1 mg |
| Fine grain silver iodobromide emulsion (average grain size 0.06 μm, AgI content 1 mol %) | 0.1 gram as silver |
| Gelatin | 0.4 gram |
| Twentieth Layer Third Protective Layer | |
| Gelatin | 0.4 gram |
| Poly(methyl methacrylate) (average particle size 1.5μ) | 0.1 gram |
| Methyl methacrylate/acrylic acid (4:6 by mol) copolymer (average particle size 1.5μ) | 0.1 gram |
| Silicone oil | 0.03 gram |
| Surfactant W-1 | 3.0 mg |
| Surfactant W-2 | 0.03 gram |

Furthermore, additives F-1 to F-8 were added to all of the emulsion layers in addition to the components indicated above. Moreover, the gelatin hardening agent H-1 and the surfactants W-3 and W-4 for coating purposes and emulsification purposes were added to each layer in addition to the components indicated above.

Moreover, phenol, 1,2-benzisothiazolin-3-one, 2-phenoxyethanol and phenethyl alcohol were added as biocides and fungicides.

The silver iodobromide emulsions used in sample 101 are indicated below.

| Emulsion | | Average Grain Size (μm) | Variation Coefficient (%) | AgI Content (%) |
|---|---|---|---|---|
| A | Mono-disperse tetradecahedral grains | 0.25 | 16 | 3.7 |
| B | Mono-disperse cubic internal latent image type grains | 0.30 | 10 | 3.3 |
| C | Mono-disperse tetradecahedral grains | 0.30 | 18 | 5.0 |
| D | Poly-disperse twinned crystal grains | 0.60 | 25 | 2.0 |
| E | Mono-disperse cubic grains | 0.17 | 17 | 4.0 |
| F | Mono-disperse cubic grains | 0.20 | 16 | 4.0 |
| G | Mono-disperse cubic internal latent image type grains | 0.25 | 11 | 3.5 |
| H | Mono-disperse cubic internal latent image type grains | 0.30 | 9 | 3.5 |
| I | Poly-disperse tabular grains, average aspect ratio 4.0 | 0.80 | 28 | 1.5 |
| J | Mono-disperse tetradecahedral grains | 0.30 | 18 | 4.0 |
| K | Mono-disperse tetradecahedral grains | 0.37 | 17 | 4.0 |
| L | Mono-disperse cubic internal latent image type grains | 0.46 | 14 | 3.5 |
| M | Mono-disperse cubic grains | 0.55 | 13 | 4.0 |
| N | Poly-disperse tabular grains, average aspect ratio 7.0 | 1.00 | 33 | 1.3 |

Spectral Sensitization of Emulsions A to N

| Emulsion | Sensitizing Dye Added | Amount Added per Mol Silver Halide | Time At Which Sensitizing Dye Was Added |
|---|---|---|---|
| A | S-1 | 0.025 | Immediately after chemical sensitization |
| | S-2 | 0.25 | Immediately after chemical sensitization |
| B | S-1 | 0.01 | Immediately after the end of grain formation |
| | S-2 | 0.25 | Immediately after the end of grain formation |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after the end of grain formation |
| | S-4 | 0.08 | Immediately after the end of grain formation |
| H | S-3 | 0.2 | During grain formation |
| | S-4 | 0.06 | During grain formation |
| I | S-3 | 0.3 | Immediately before start of chemical sensitization |
| | S-4 | 0.07 | Immediately before start of chemical sensitization |
| | S-8 | 0.1 | Immediately before start of chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Immediately after the end of grain formation |
| | S-5 | 0.06 | Immediately after the end of grain formation |
| M | S-6 | 0.15 | Immediately after chemical sensitization |
| | S-5 | 0.04 | Immediately after chemical sensitization |
| N | S-6 | 0.22 | Immediately after the end of grain formation |
| | S-5 | 0.06 | Immediately after the end of grain formation |

C-1
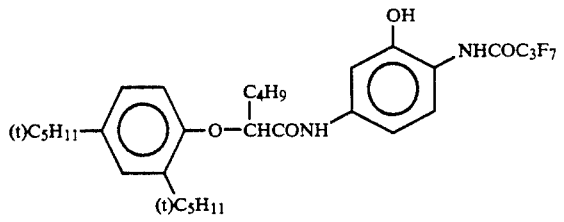
C-2
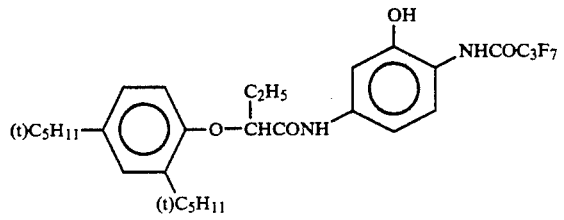
C-3
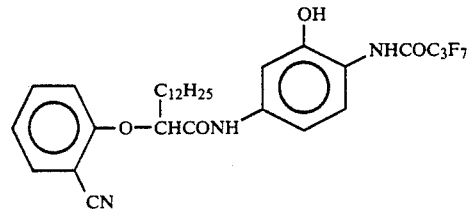
C-4
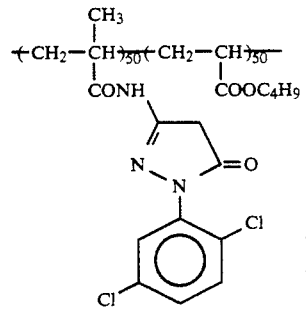
Numbers indicate wt %
Average Molecular Weight: About 25,000
C-5
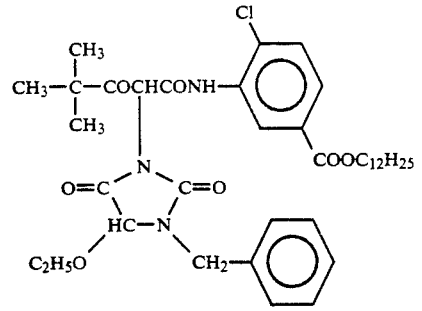
C-6
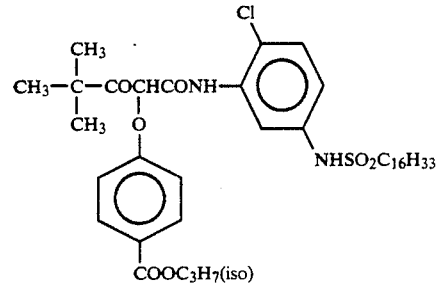

-continued
C-7
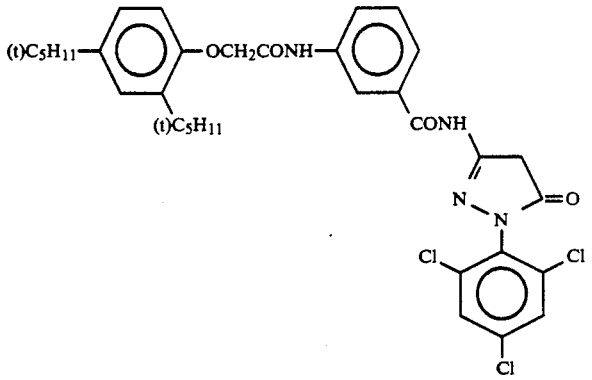
C-8
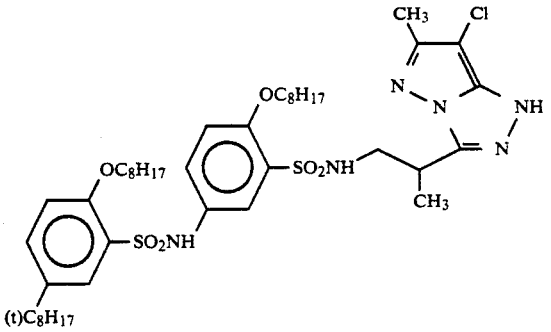
C-9
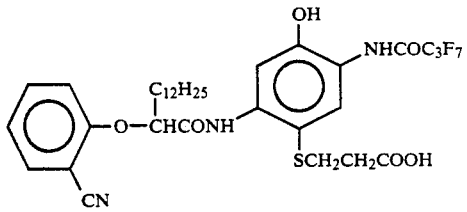
Dibutyl phthalate — Oil-1
Tricresyl phosphate — Oil-2
Oil-3
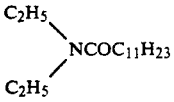
Cpd-A
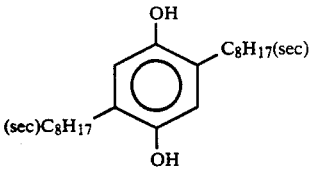
Cpd-B
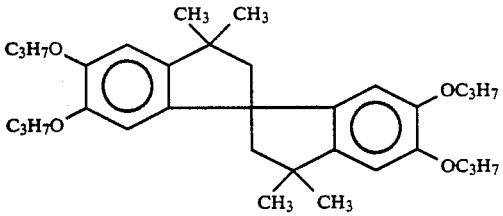
Cpd-C
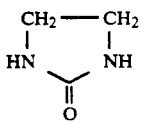

-continued
Cpd-D
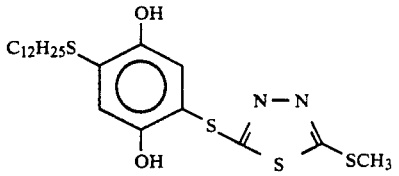
Cpd-E
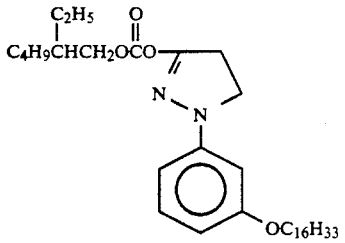
Cpd-F
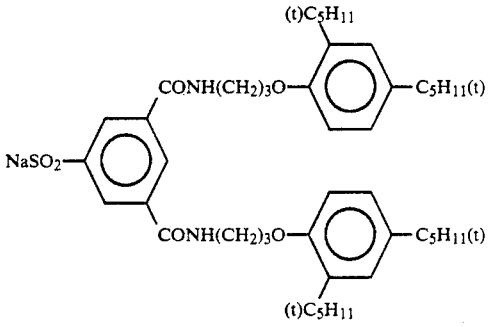
Cpd-G
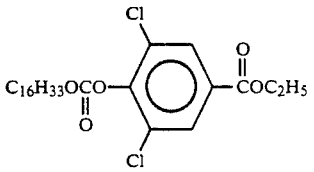
Cpd-H
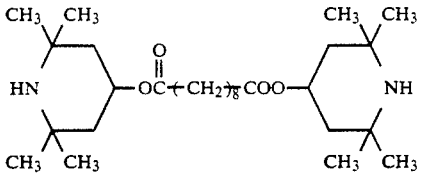
Cpd-I
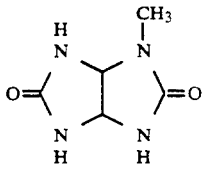
Cpd-K
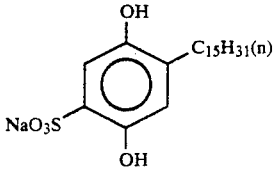

-continued
Cpd-L
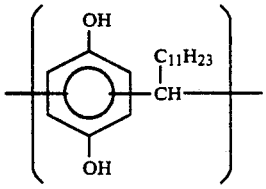
Average Molecular Weight 5000–40000
U-1
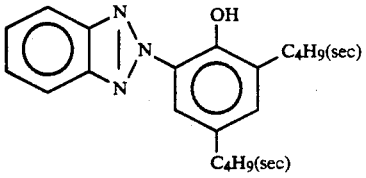
U-2
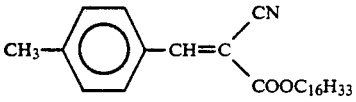
U-3
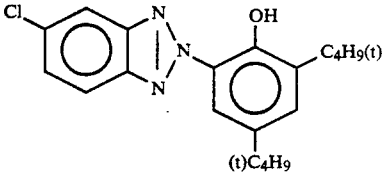
U-4
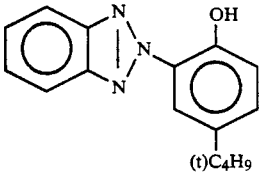
U-5
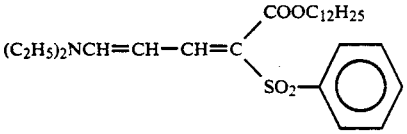
U-6
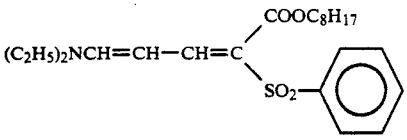
S-1
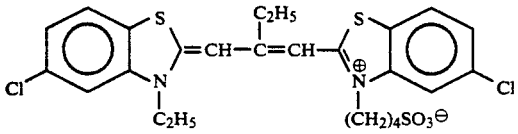
S-2
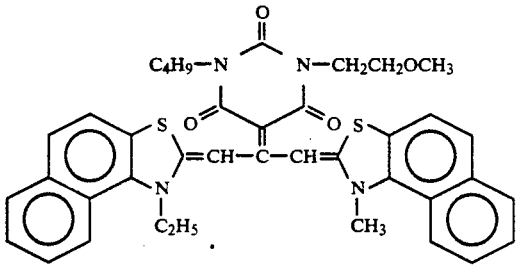

-continued
S-3
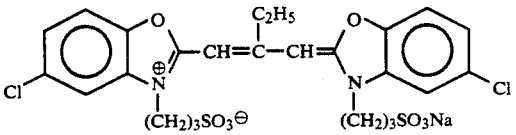
S-4
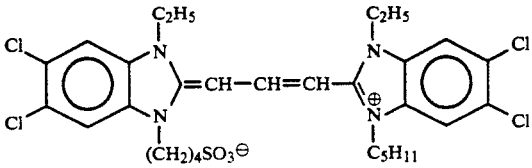
S-5
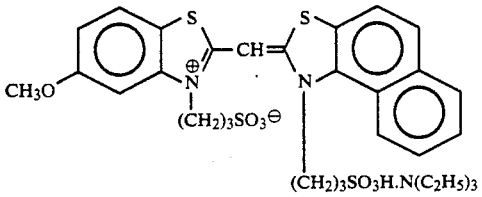
S-6
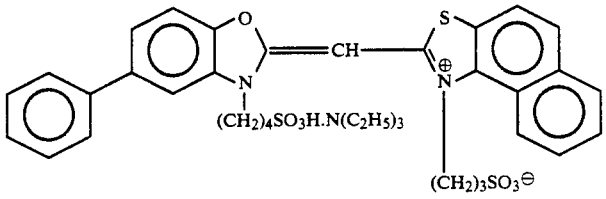
S-7
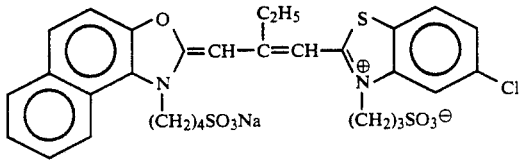
S-8
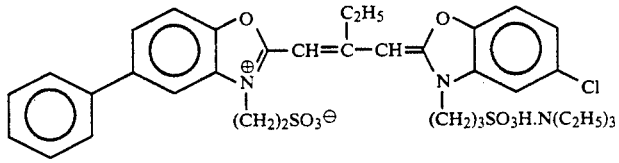
D-1
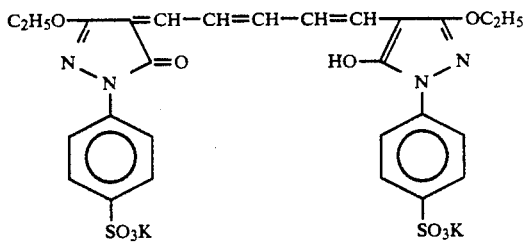
D-2
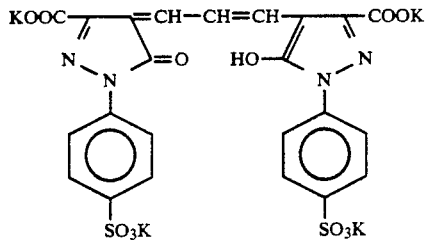

-continued
D-3
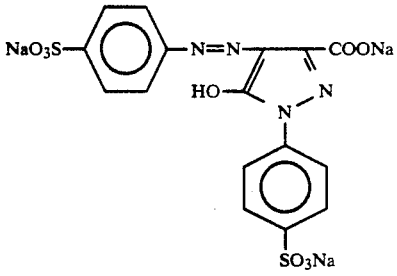
D-4
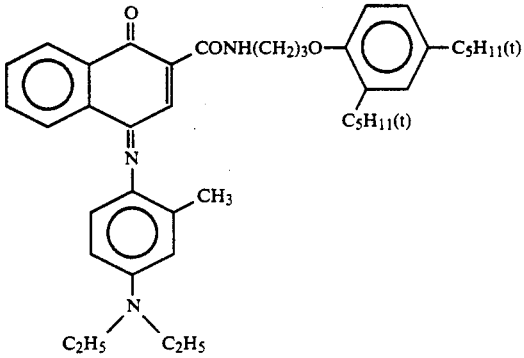
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_17SO_2NHCH_2CH_2CH_2OCH_2CH_2\overset{\oplus}{N}(CH_3)_3$
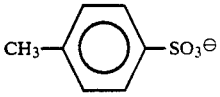
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
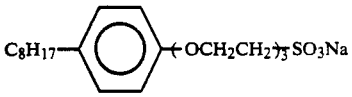
P-1
$\text{-}(CH_2{-}CH(CONHC_4H_9(t))\text{-})_n\text{-}$ n = 300 (average)
M-1
$\text{-}(CH_2{-}CH(COOC_4H_9)\text{-})_n\text{-}$ n = 500 (average)
F-1
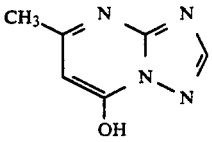

-continued

F-2

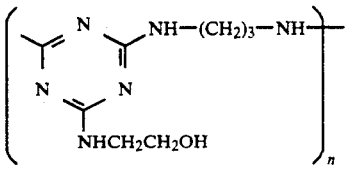

—$HNO_3$ n = 5 (average)

F-3

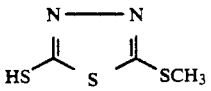

F-4

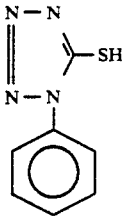

F-5

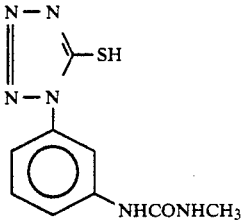

F-6

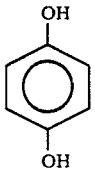

F-7

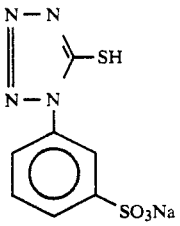

F-8

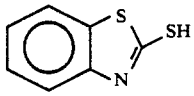

Preparation of Samples 102–118

Samples 102 to 118 were prepared in the same way as sample 101 except that the couplers added to the ninth, tenth, eleventh and fifteenth, sixteenth and seventeenth layers of sample 101 were replaced with equimolar amount of the comparative compounds and coupler compounds of the present invention shown in table 1.

The samples 101 to 118 which had been prepared in this way were processed for 35 mm size magazines and used as camera materials. The subject used was a color chicker made by the Macbeth Co. and development processing was carried out using the color developer A indicated below. The samples obtained were evaluated in terms of color reproduction by a number of evaluators. The yellow color reproduction in particular was compared.

Furthermore, after cutting samples 101 to 118 into strips, they were subjected to a graded exposure through an optical wedge and then developed and processed using the color developer A indicated below. The processed strips were subjected to density measurements and the magenta density at the point which had a yellow density of fog+2.0 was measured and this is shown in table 1 as the degree of color mixing.

Moreover, samples 101 to 1158 were subjected to a graded exposure through an optical wedge and then developed and processed using the color developer A indicated below. Furthermore, samples were exposed in the same way as above and developed and processed using the color developer B indicated below. The magenta and yellow maximum image densities ($D_{max}$) and minimum image densities ($D_{min}$) of these processed strips were measured.

The results obtained are shown in table 1.

| Processing Operation | Processing Operations Time (min) | Temp. (°C.) | Tank Capacity (liters) | Replenishment Rate (l/m²) |
|---|---|---|---|---|
| Black & White Development | 6 | 38 | 12 | 2.2 |
| First Water Wash | 2 | 38 | 4 | 7.5 |
| Reversal | 2 | 38 | 4 | 1.1 |
| Color Development | 6 | 38 | 12 | 2.2 |
| Conditioning | 2 | 38 | 4 | 1.1 |
| Bleaching | 6 | 38 | 12 | 0.22 |
| Fixing | 4 | 38 | 8 | 1.1 |
| Second Water Wash | 4 | 38 | 8 | 7.5 |
| Stabilization | 1 | 25 | 2 | 1.1 |

| Black and White Developer | Parent Bath | Replenisher |
|---|---|---|
| Nitrilo-N,N,N-trimethylenephosphonic acid pentasodium salt | 2.0 grams | 2.0 grams |
| Sodium sulfite | 30.0 grams | 30.0 grams |
| Hydroquinone monosulfonic acid potassium salt | 20.0 grams | 20.0 grams |
| Potassium carbonate | 33.0 grams | 33.0 grams |
| 1-Phenyl-4-methyl-4-hydroxymethyl-3-pyrazolidone | 2.0 grams | 2.0 grams |
| Potassium bromide | 2.5 grams | 1.4 grams |
| Potassium thiocyanate | 1.2 grams | 1.2 grams |
| Potassium iodide | 2.0 mg | |
| Water to make up to | 1,000 ml | 1,000 ml |
| pH | 9.60 | 9.60 |

The pH was adjusted with hydrochloric acid or potassium hydroxide.

| Reversal Bath | Parent Bath | Replenisher |
|---|---|---|
| Nitrilo-N,N,N-trimethylenephosphonic acid pentasodium salt | 3.0 grams | Same as Parent Bath |
| Stannous chloride di-hydrate | 1.0 gram | |
| p-Aminophenol | 0.1 gram | |
| Sodium hydroxide | 8 grams | |
| Glacial acetic acid | 15 ml | |
| Water to make up to | 1,000 ml | |
| pH | 6.00 | |

The pH was adjusted with hydrochloric acid or sodium hydroxide.

| Color Developer A | Parent Bath | Replenisher |
|---|---|---|
| Nitrilo-N,N,N-trimethylenephosphonic acid pentasodium salt | 2.0 grams | 2.0 grams |
| Sodium sulfite | 7.0 grams | 7.0 grams |
| Tri-sodium phosphate dodeca-hydrate | 36 grams | 36 grams |
| Potassium bromide | 1.0 gram | — |
| Potassium iodide | 90 mg | — |

-continued

| Color Developer A | Parent Bath | Replenisher |
|---|---|---|
| Sodium hydroxide | 3.0 grams | 3.0 grams |
| Citrazinic acid | 1.5 grams | 1.5 grams |
| N-Ethyl-(β-methanesulfonamidoethyl)-3-methyl-4-aminoaniline sulfate | 11 grams | 11 grams |
| 3,6-Dithia-1,8-octanediol | 1.0 grams | 1.0 grams |
| Water to make up to | 1,000 ml | 1,000 ml |
| pH | 11.80 | 12.00 |

The pH was adjusted with hydrochloric acid or potassium hydroxide.

| Conditioner | Parent Bath | Replenisher |
|---|---|---|
| Ethylenediamine tetra-acetic acid di-sodium salt di-hydrate | 8.0 grams | Same as Parent Bath |
| Sodium sulfite | 12 grams | |
| 1-Thioglycerine | 0.4 ml | |
| Sorbitane ester* | 0.1 gram | |
| Water to make up to | 1,000 ml | |
| pH | 6.20 | |

pH adjusted with hydrochloric acid or sodium hydroxide.*: Sorbitane Ester:

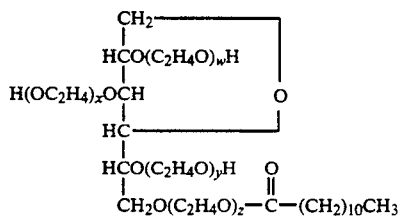

(w + x + y + z = 20)

| Bleaching Bath | Parent Bath | Replenisher |
|---|---|---|
| Ethylenediamine tetra-acetic acid di-sodium salt di-hydrate | 2.0 grams | 4.0 grams |
| Ethylene diamine tetra-acetic acid ferric ammonium salt di-hydrate | 120 grams | 240 grams |
| Potassium bromide | 100 grams | 200 grams |
| Ammonium nitrate | 10 grams | 20 grams |
| Water to make up to | 1,000 ml | 1,000 ml |
| pH | 5.70 | 5.50 |

The pH was adjusted with hydrochloric acid or sodium hydroxide.

| Fixer | Parent Bath | Replenisher |
|---|---|---|
| Ammonium thiosulfate | 8.0 grams | Same as Parent Bath |
| Sodium sulfite | 5.0 grams | |
| Sodium bisulfite | 5.0 grams | |
| Water to make up to | 1,000 ml | |
| pH | 6.60 | |

The pH was adjusted with hydrochloric acid or aqueous ammonia.

| Stabilizer | Parent Bath | Replenisher |
|---|---|---|
| Formalin (37%) | 5.0 ml | Same as Parent Bath |

-continued

| Stabilizer | Parent Bath | Replenisher |
|---|---|---|
| Polyoxyethylene p-mono nonylphenyl ether (average degree of polymerization 10) | 0.5 ml | |
| Water to make up to | 1,000 ml | |
| pH | Not Adjusted | |

Color Developer B

The amount of sodium hydroxide in color developer A was changed and the pH was adjusted from 11.80 to 12.00.

| | |
|---|---|
| First Layer Anti-halation Layer | |
| Black colloidal silver | 0.15 |
| Gelatin | 1.90 |
| Second Layer Intermediate Layer | |
| Gelatin | 2.10 |
| ExM-8 | $2.0 \times 10^{-2}$ |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| Third Layer Low Speed Red Sensitive Emulsion Layer | |
| Silver iodobromide emulsion (AgI 2 mol %, high internal AgI type, corresponding sphere diameter 0.3 μm, variation coefficient of corresponding sphere diameter 29%, regular crystal grain/twinned crystal grain mixture, diameter/thickness ratio 2.5) | 0.50 as silver |
| Gelatin | 1.50 |
| ExS-1 | $1.0 \times 10^{-4}$ |
| ExS-2 | $3.0 \times 10^{-4}$ |
| ExS-3 | $1.0 \times 10^{-4}$ |
| ExC-3 | 0.22 |
| ExC-4 | $3.0 \times 10^{-3}$ |
| Solv-1 | $7.0 \times 10^{-3}$ |
| Fourth Layer (Intermediate Speed Red Sensitive Emulsion Layer) | |
| Silver iodobromide emulsion (AgI 4 mol %, high internal AgI type, corresponding sphere | 0.85 as silver |

TABLE 1

| | Sample | Magenta Coupler | Yellow Coupler | Color reproduction[1] Magenta | Yellow | Red | Green | Degree of color Mixing | Processing Dependence of the Magenta Image $D_{max}$ A[2] | $D_{max}$ B[2] | $D_{min}$ A | $D_{min}$ B | Processing Dependence of the Yellow Image $D_{max}$ A | $D_{max}$ B | $D_{min}$ A | $D_{min}$ B |
|---|---|---|---|---|---|---|---|---|---|---|---|---|---|---|---|---|
| 101 | Comparative Example | C-4 | C-5 | Δ | Δ | Δ | Δ | 0.46 | 3.78 | 3.74 | 0.16 | 0.15 | 3.62 | 3.57 | 0.16 | 0.15 |
| 102 | Comparative Example | C-7 | " | Δ | Δ | Δ | Δ | 0.45 | 3.85 | 3.81 | 0.17 | 0.15 | 3.62 | 3.54 | 0.17 | 0.15 |
| 103 | Comparative Example | " | Y-15 | Δ | ○ | Δ | ○ | 0.45 | 3.85 | 3.81 | 0.17 | 0.15 | 3.64 | 3.57 | 0.18 | 0.15 |
| 104 | Comparative Example | C-8 | C-5 | ○ | Δ | Δ | Δ | 0.46 | 3.90 | 3.82 | 0.18 | 0.15 | 3.62 | 3.55 | 0.17 | 0.15 |
| 105 | Comparative Example | " | C-6 | ○ | Δ | Δ | Δ | 0.45 | 3.91 | 3.82 | 0.18 | 0.15 | 3.64 | 3.57 | 0.18 | 0.15 |
| 106 | This Invention | " | Y-15 | ○ | ○ | ○ | ○ | 0.43 | 3.89 | 3.86 | 0.17 | 0.15 | 3.64 | 3.61 | 0.16 | 0.15 |
| 107 | This Invention | M-1 | Y-1 | ○ | ○ | ○ | ○ | 0.43 | 3.88 | 3.86 | 0.16 | 0.15 | 3.63 | 3.59 | 0.16 | 0.15 |
| 108 | This Invention | M-5 | Y-3 | ○ | ○ | ○ | ○ | 0.43 | 3.92 | 3.86 | 0.16 | 0.15 | 3.62 | 3.59 | 0.16 | 0.15 |
| 109 | This Invention | M-5 | Y-10 | ○ | ○ | ○ | ○ | 0.43 | 3.90 | 3.87 | 0.16 | 0.15 | 3.64 | 3.60 | 0.16 | 0.15 |
| 110 | This Invention | C-8 | Y-20 | ○ | ○ | ○ | ○ | 0.43 | 3.89 | 3.85 | 0.16 | 0.15 | 3.63 | 3.60 | 0.16 | 0.15 |
| 111 | This Invention | M-20 | Y-23 | ○ | ○ | ○ | ○ | 0.43 | 3.91 | 3.86 | 0.16 | 0.15 | 3.65 | 3.62 | 0.16 | 0.15 |
| 112 | This Invention | M-26 | Y-15 | ○ | ○ | ○ | ○ | 0.42 | 3.91 | 3.87 | 0.16 | 0.15 | 3.64 | 3.60 | 0.15 | 0.15 |
| 113 | This Invention | " | Y-10 | ○ | ○ | ○ | ○ | 0.43 | 3.91 | 3.87 | 0.16 | 0.15 | 3.64 | 3.61 | 0.16 | 0.15 |
| 114 | This Invention | M-27 | Y-3 | ○ | ○ | ○ | ○ | 0.43 | 3.89 | 3.85 | 0.16 | 0.15 | 3.62 | 3.58 | 0.16 | 0.15 |
| 115 | This Invention | M-21 | Y-23 | ○ | ○ | ○ | ○ | 0.43 | 3.92 | 3.89 | 0.16 | 0.15 | 3.64 | 3.60 | 0.16 | 0.15 |
| 116 | This Invention | M-6 | Y-15 | ○ | ○ | ○ | ○ | 0.43 | 3.92 | 3.88 | 0.16 | 0.15 | 3.63 | 3.59 | 0.16 | 0.15 |
| 117 | This Invention | M-6 | Y-10 | ○ | ○ | ○ | ○ | 0.43 | 3.90 | 3.87 | 0.16 | 0.15 | 3.63 | 3.60 | 0.16 | 0.15 |
| 118 | This Invention | M-26 | Y-20 | ○ | ○ | ○ | ○ | 0.42 | 3.92 | 3.88 | 0.16 | 0.15 | 3.63 | 3.60 | 0.16 | 0.15 |

[1]Color reproduction Δ: Slight deterioration ○: Excellent
[2]Type of color developer It is clear from the results shown in Table 1 that in comparison to the comparative examples there is no great change in the maximum image density ($D_{max}$) and the minimum image density ($D_{min}$) with a change in the pH of color developer with the present invention, the color forming properties are good and color reproduction is also improved.

EXAMPLE 2

Sample 201 was prepared in the following manner.

Preparation of Sample 201

Coated weights are shown in units of grams Ag/m$^2$ in the case of silver halides and colloidal silver, in units of g/m$^2$ in the case of couplers, additives and gelatin, and in units of mol per mol of silver halide in the same layer in the case of the sensitizing dyes.

-continued

| | |
|---|---|
| diameter 0.55 μm, variation coefficient of corresponding sphere diameter 20%, regular crystal grain/twinned crystal grain mixture, diameter/thickness ratio 1.0) | |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-2 | $8.0 \times 10^{-2}$ |
| ExC-3 | 0.33 |
| ExY-13 | $2.0 \times 10^{-2}$ |
| ExY-14 | $1.0 \times 10^{-2}$ |
| Cpd-10 | $1.0 \times 10^{-4}$ |
| Solv-1 | 0.10 |
| Fifth Layer (High Speed Red Sensitive Emulsion Layer) | |
| Silver iodobromide emulsion (AgI 10 mol %, high internal AgI type, corresponding sphere diameter 0.7 μm, variation coefficient of corresponding sphere diameter 30%, regular crystal grain/twinned crystal grain mixture, diameter/thickness ratio 2.0) | 0.70 as silver |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| Solv-1 | 0.15 |
| Solv-2 | $8.0 \times 10^{-2}$ |
| Sixth Layer (Intermediate Layer) | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Seventh Layer (Low Speed Green Sensitive Emulsion Layer) | |
| Silver iodobromide emulsion (AgI 2 mol %, high internal AgI type, corresponding sphere diameter 0.3 μm, variation coefficient of corresponding sphere diameter 28%, regular crystal grain/twinned crystal grain mixture, diameter/thickness ratio 2.5) | 0.30 as silver |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-8 | 0.20 |
| ExY-13 | $3.0 \times 10^{-2}$ |
| Cpd-11 | $7.0 \times 10^{-3}$ |
| Solv-1 | 0.20 |
| Eigth Layer (Intermediate Speed Green Sensitive Emulsion Layer) | |
| Silver iodobromide emulsion (AgI 4 mol %, high internal AgI type, corresponding sphere diameter 0.55 μm, variation coefficient of corresponding sphere diameter 20%, regular crystal grain/twinned crystal grain mixture, diameter/thickness ratio 4.0) | 0.70 as silver |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-8 | 0.25 |
| ExM-10 | $1.5 \times 10^{-2}$ |
| ExY-13 | $4.0 \times 10^{-2}$ |
| Cpd-11 | $9.0 \times 10^{-3}$ |
| Solv-1 | 0.20 |
| Ninth Layer (High Speed Green Sensitive Emulsion Layer) | |
| Silver iodobromide emulsion (AgI 10 mol %, high interal AgI type, corresponding sphere diameter 0.7 μm, variation coefficient of corresponding sphere diameter 30%, regular crystal grain/twinned crystal grain mixture, diameter/thickness ratio 2.0) | 0.50 as silver |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-8 | 0.10 |
| ExM-12 | $2.0 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| Tenth Layer (Yellow Filter Layer) | |
| Gelatin | 0.90 |
| Yellow colloidal silver | $5.0 \times 10^{-2}$ |
| Cpd-1 | 0.20 |
| Solv-1 | 0.15 |
| Eleventh Layer (Low Speed Blue Sensitive Emulsion Layer) | |
| Silver iodobromide emulsion (AgI 4 mol %, high internal AgI type, corresponding sphere diameter 0.5 μm, variation coefficient of the corresponding sphere diameter 15%, octahedral grains) | 0.40 as silver |
| Gelatin | 1.00 |
| ExS-8 | $2.0 \times 10^{-4}$ |
| ExY-15 | 0.90 |
| Solv-1 | 0.30 |
| Cpd-2 | $1.0 \times 10^{-2}$ |
| Twelfth Layer (High Speed Blue Sensitive Emulsion Layer) | |
| Silver iodobromide emulsion (AgI 10 mol %, high internal AgI type, corresponding sphere diameter 1.3 μm, variation coefficient of the corresponding sphere diameter 25%, regular crystal grain/twinned crystal grain mixture, diameter/thickness ratio 4.5) | 0.50 as silver |
| Gelatin | 0.60 |
| ExS-8 | $1.0 \times 10^{-4}$ |
| ExY-15 | 0.12 |
| Cpd-2 | $1.0 \times 10^{-3}$ |
| Solv-1 | $4.0 \times 10^{-2}$ |
| Thirteenth Layer (First Protective Layer) | |
| Fine grain silver iodobromide (average grain size 0.07μ, AgI 1 mol %) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| Fourteenth Layer (Second Protective Layer) | |
| Gelatin | 0.90 |
| B-1 (Diameter 1.5 μm) | 0.10 |
| B-2 (Diameter 1.5 μm) | 0.10 |
| B-3 | $2.0 \times 10^{-2}$ |
| H-1 | 0.40 |

Moreover, Cpd-3, Cpd-5, Cpd-6, Cpd-7, Cpd-8, P-1, W-1, W-2 and W-3 indicated below were added in order to improve storage properties, processing properties and pressure resistance, for biocidal and fungicidal purposes, for anti-static purposes and for improving the coating properties.

n-Butyl p-hydroxybenzoate was added in addition to the above mentioned compounds. Moreover, B-4, F-1, F-4, F-5, F-6, F-7, F-8, F-9, F-10, F-11 and F-13, and iron salts, lead salts, gold salts, platinum salts, iridium salts and rhodium salts were included.

The structural formulae or chemical names of the compounds used in the present invention are indicated below.

UV-1

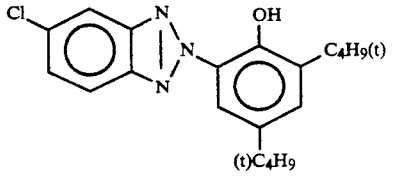

UV-2

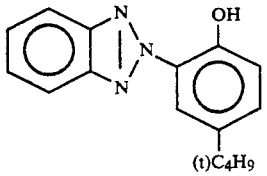

UV-3

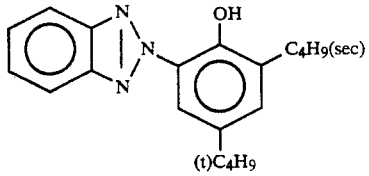

UV-4

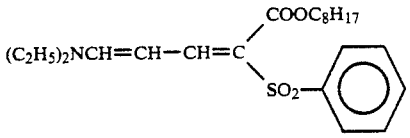

Tricresyl phosphate — Solv-1

Dibutyl phthalate — Solv-2

Tri(2-ethylhexyl)phosphate — Solv-3

ExF-1

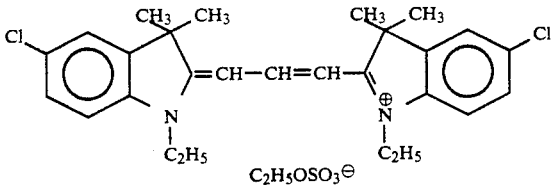

ExC-2

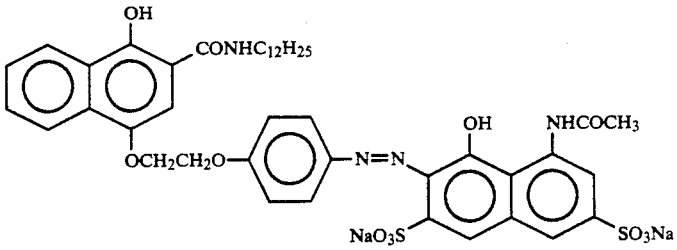

ExC-3

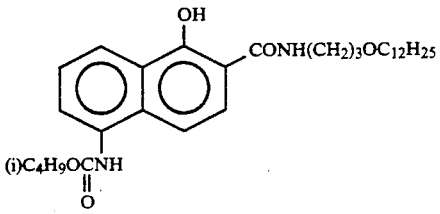

-continued
ExC-4
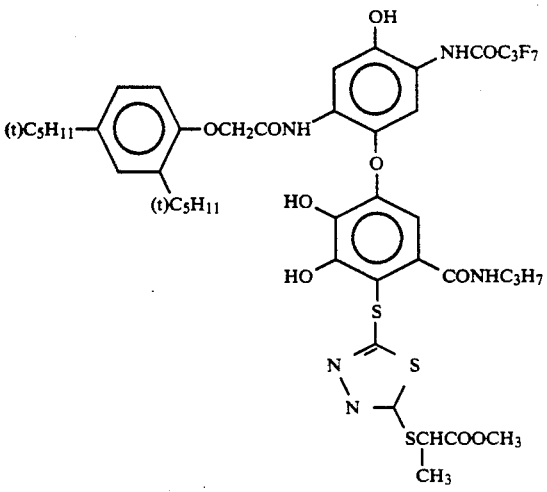
ExC-5
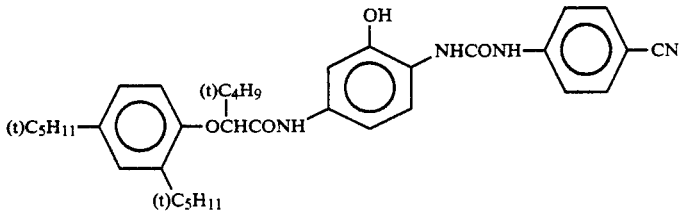
ExC-6
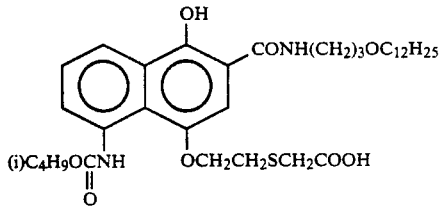
ExM-8
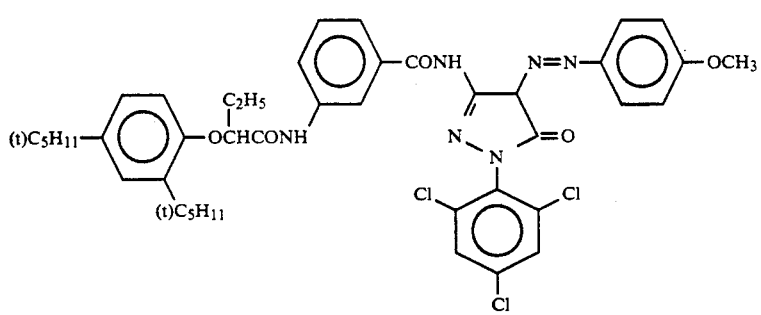
ExM-9
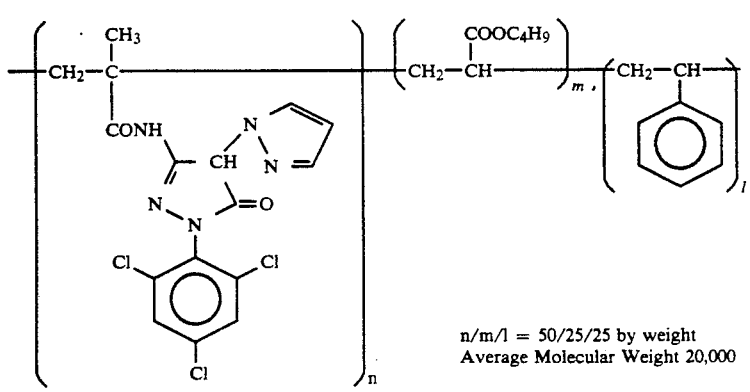
n/m/l = 50/25/25 by weight
Average Molecular Weight 20,000

-continued
ExM-10
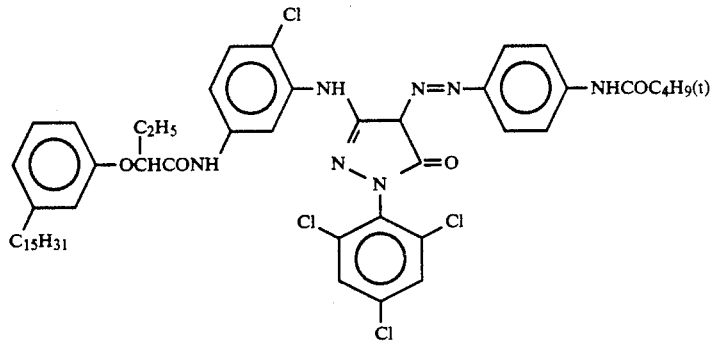
ExM-12
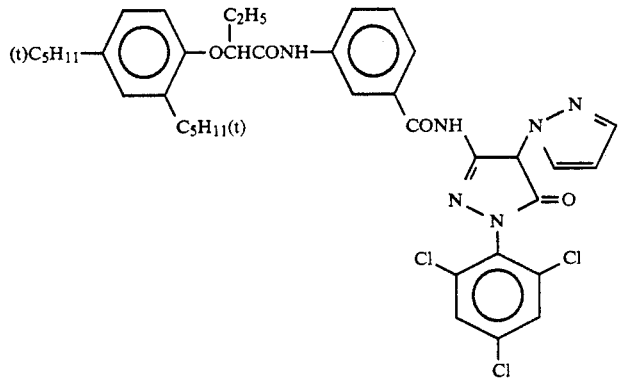
ExY-13
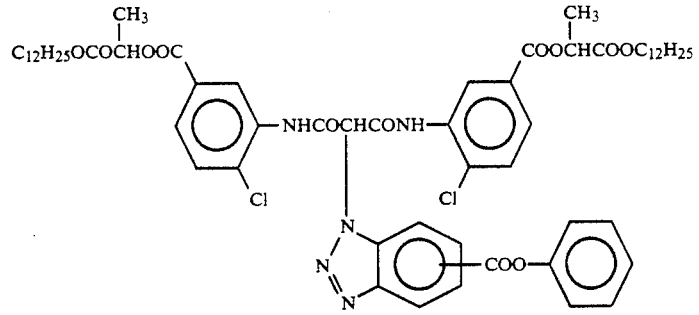
ExY-14
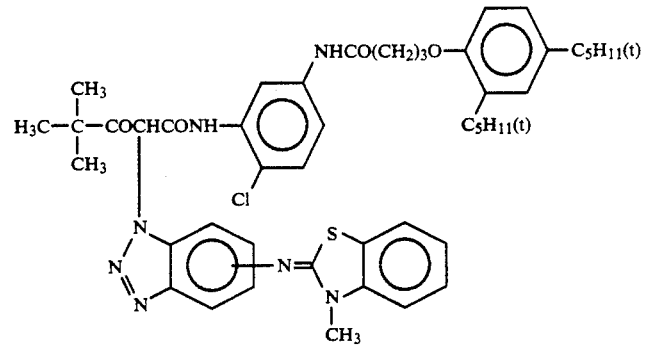

-continued
ExY-15
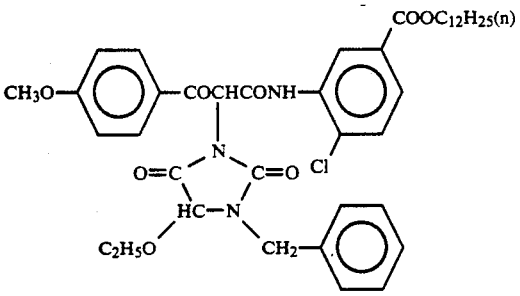
Cpd-1
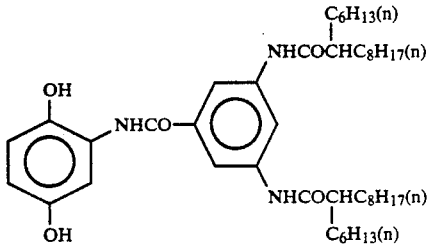
Cpd-2
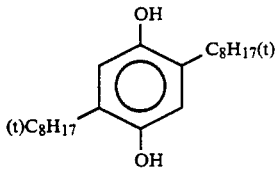
Cpd-3
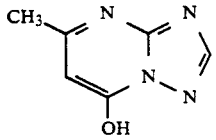
Cpd-4
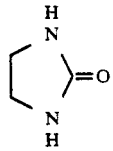
Cpd-5
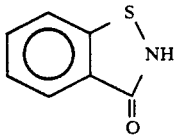
Cpd-6
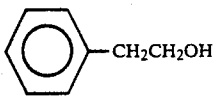
Cpd-7
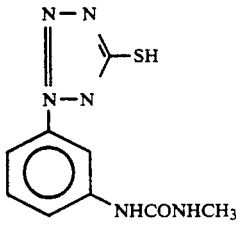
Cpd-8
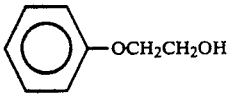

-continued
Cpd-9
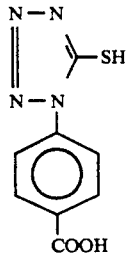
Cpd-10
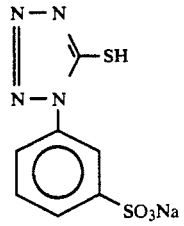
Cpd-11
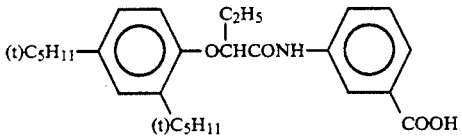
ExS-1
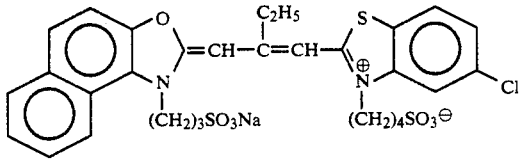
ExS-2
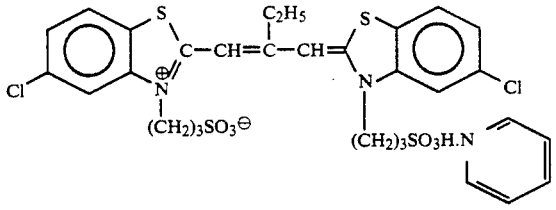
ExS-3
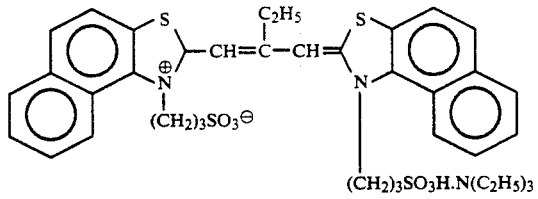
ExS-4
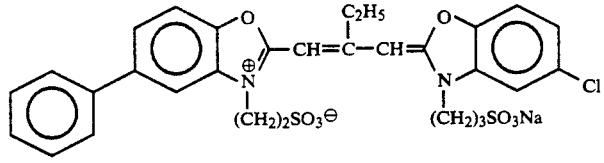
ExS-5
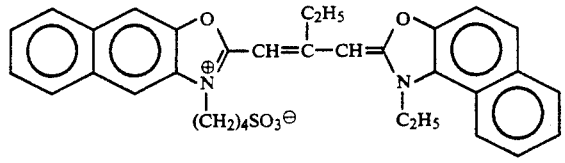

-continued
ExS-6
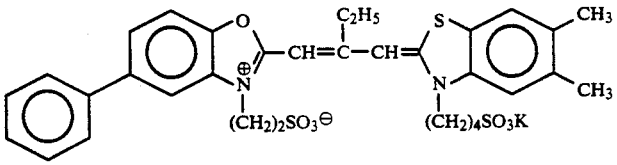
ExS-7
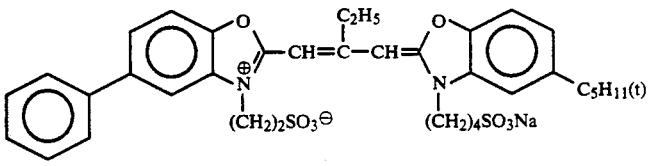
ExS-8
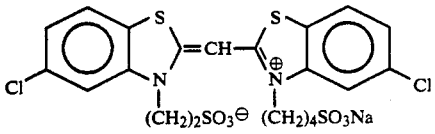
B-1
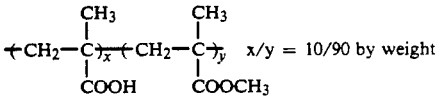
x/y = 10/90 by weight
B-2
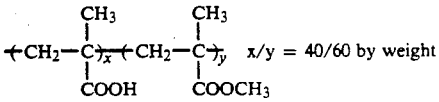
x/y = 40/60 by weight
B-3
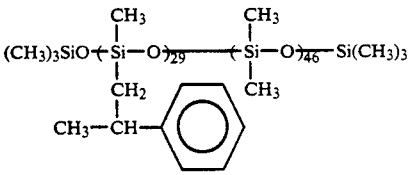
B-4
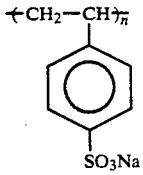
n = about 100
H-1
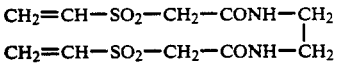
W-1
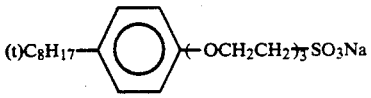
W-2
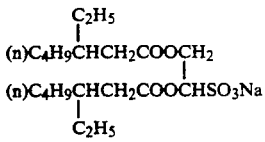
W-3
$C_8F_{17}SO_2N(C_3H_7)CH_2COOK$
P-1
Vinylpyrrolidone/vinyl alcohol copolymer
(Copolymer ration (by weight) = 70:30
P-2
Poly(ethyl acrylate)

-continued

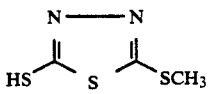

F-1

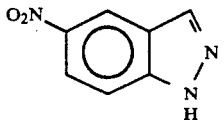

F-4

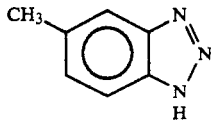

F-5

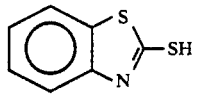

F-6

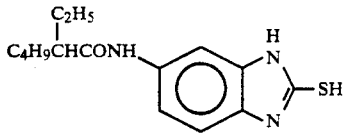

F-7

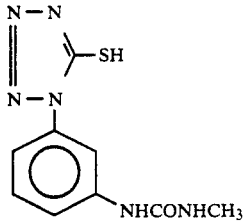

F-8

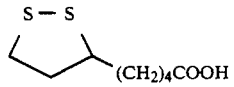

F-9

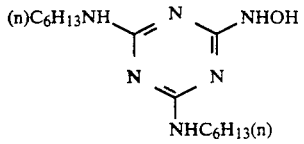

F-10

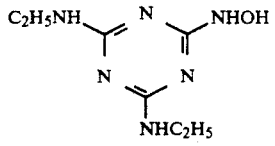

F-11

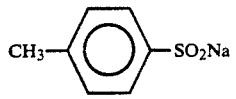

F-13

Preparation of Samples 202–218

Samples 202 to 218 were prepared in the same way as sample 101 except that the couplers which were added to the seventh, eighth and ninth, and eleventh and twelfth layers of sample 201 were replaced with equimolar amount of the comparative compounds and coupler compounds of the present invention shown in Table 2. The samples prepared were tested with development processing as indicated below as in example 1, and the results obtained were the same as those obtained in Example 1.

After exposing the color photographic materials in the way described above, they were processed in accordance with the procedure outlined below in an automatic processor (until the cumulative replenishment of the baths reaches three times the parent bath capacity).

| Color Development Processing | | | | |
|---|---|---|---|---|
| Process | Processing Time | Processing Temp. | Replenishment Rate* | Tank Capacity |
| Color development | 3 min. 15 sec. | 38° C. | 33 ml | 20 liters |
| Bleach | 6 min. 30 sec. | 38° C. | 25 ml | 40 liters |
| Water Wash | 2 min. 10 sec. | 24° C. | 1200 ml | 20 liters |
| Fixing | 4 min. 20 sec. | 38° C. | 24 ml | 30 liters |
| Water Wash (1) | 1 min. 05 sec. | 24° C. | Note 1 | 10 liters |
| Water Wash (2) | 1 min. 00 sec. | 24° C. | 1200 ml | 10 liters |
| Stabilization | 1 min. 05 sec. | 38° C. | 25 ml | 10 liters |
| Drying | 4 min. 20 sec. | 55° C. | | |

Replenishment rate per meter of 35 mm wide material
Note 1:
A counter-flow system from (2) to (1)

The composition of each processing bath is as indicated below.

| | Parent Bath (grams) | Replenisher (grams) |
|---|---|---|
| Color Developer A | | |
| Diethylenetriamine penta-acetic acid | 1.0 | 1.1 |
| 1-Hydroxyethylidene-1,1-di-phosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxyethyl-amino]-2-methylaniline sulfate | 4.5 | 5.5 |
| Water to make up to | 1.0 liter | 1.0 liter |
| pH | 10.05 | 10.10 |
| Bleach | | |
| Ethylenediamine tetra-acetic acid ferric sodium salt tri-hydrate | 100.0 | 120.0 |
| Ethylenediamine tetra-acetic acid di-sodium salt | 10.0 | 10.0 |
| Ammonium bromide | 140.0 | 160.0 |
| Ammonium nitrate | 30.0 | 35.0 |
| Aqueous ammonia (27%) | 6.5 ml | 4.0 ml |
| Water to make up to | 1.0 l | 1.0 l |
| pH | 6.0 | 5.7 |
| Fixing | | |
| Ethylenediamine tetra-acetic acid, di-sodium salt | 0.5 | 0.7 |
| Sodium sulfite | 7.0 | 8.0 |
| Sodium bisulfite | 5.0 | 5.5 |
| Aqueous ammonium thio-sulfate solution (70 wt/vol %) | 170.0 ml | 200.0 ml |
| Water to make up to | 1.0 l | 1.0 l |
| pH | 6.7 | 6.6 |
| Stabilizer | | |
| Formalin (37%) | 2.0 ml | 3.0 ml |
| Polyoxyethylene p-mono-nonylphenyl ether (average degree of polymerization 10) | 0.3 | 0.45 |
| Ethylenediamine tetra-acetic acid di-sodium salt | 0.05 | 0.08 |
| Water to make up to | 1.0 l | 1.0 l |
| pH | 5.0–8.0 | 5.0–8.0 |

Color Developer B

The amount of potassium carbonate in color developer A was changed and the pH was adjusted from 10.05 to 9.60.

TABLE 2

| Sample | Magenta Coupler | Yellow Coupler |
|---|---|---|
| 201 (Comparative Example) | ExM-8 | ExY-15 |
| 202 (Comparative Example) | ExM-8 | Y-15 |
| 203 (Comparative Example) | ExM-9 | Y-15 |

TABLE 2-continued

| Sample | Magenta Coupler | Yellow Coupler |
|---|---|---|
| 204 (Comparative Example) | M-1 | ExY-15 |
| 205 (Comparative Example) | M-5 | ExY-13 |
| 206 (This Invention) | M-1 | Y-15 |
| 207 (This Invention) | M-5 | Y-1 |
| 208 (This Invention) | M-12 | Y-20 |
| 209 (This Invention) | M-17 | Y-15 |
| 210 (This Invention) | M-17 | Y-10 |
| 211 (This Invention) | M-26 | Y-15 |
| 212 (This Invention) | M-27 | Y-3 |
| 213 (This Invention) | M-6 | Y-10 |
| 214 (This Invention) | M-6 | Y-23 |
| 215 (This Invention) | M-26 | Y-20 |
| 216 (This Invention) | M-8 | Y-3 |
| 217 (This Invention) | M-8 | Y-15 |
| 218 (This Invention) | M-10 | Y-8 |

EXAMPLE 3

Sample A is prepared in the same way as in Example 2 of JP-A-2-158431 except that the total number of mol of the magenta couplers (ExM-1 and ExM-2) and the yellow coupler (ExY-1) added to the sixth, seventh, eleventh and twelfth layers disclosed in the example are replaced with equimolar amounts of couplers of the present invention. Sample A is exposed and processed in the same way as described in Example 1 and results similar to those of Example 1 are obtained.

EXAMPLE 4

Sample B is prepared in the same way as in Example 2 of European Patent EP 0,355,660A2 except that the total number of mol of yellow coupler (ExY), magenta coupler (ExM) and cyan coupler (ExC) in the multi-layer color paper sample number 214 disclosed in the example are replaced with equimolar amounts of couplers of the present invention. Sample B is exposed and processed in the same way as described in Example 1 and results similar to those of example 1 are obtained.

EFFECT OF THE INVENTION

Silver halide color photographic materials which have excellent color reproduction and which exhibit no fluctuation in $D_{max}$ and $D_{min}$ as a result of fluctuations in the pH of the color developer are obtained by means of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one blue sensitive silver halide emulsion layer, at least one green sensitive silver halide emulsion layer and at least one red sensitive silver halide emulsion layer, wherein at least one type of acylacetamide type yellow coupler in which the acyl group represented by formula [I] indicated below is included in said blue sensitive silver halide emulsion layer and at least one type of magenta coupler represented by formula [M] indicated below is included in said green sensitive silver halide emulsion layer, Formula [I]

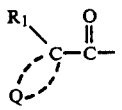

wherein $R_1$ represents a univalent group, Q represents a group of non-metal atoms which, together with C, is required to form a three to five membered hydrocarbon ring or a three to five membered heterocyclic ring which has within the ring at least one hetero atom selected from the group consisting of N, O, S and P, with the proviso that $R_1$ is not a hydrogen atom and is not linked to Q and does not form a ring, Formula [M]

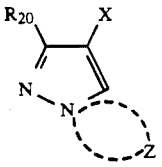

wherein $R_{20}$ represents a hydrogen atom or a substituent group, Z represents a group of non-metal atoms which is required to form a five membered azole ring which contains 2 to 4 nitrogen atoms, said azole rings may have substituent groups including condensed rings, and X represents a hydrogen atom or a coupling-off group.

2. The silver halide color photographic material of claim 1, wherein said acylacetamide type yellow coupler is represented by formula [Y]:

Formula [Y]

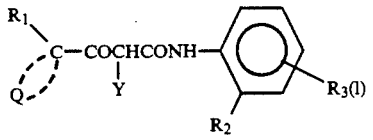

wherein $R_1$ represents a univalent group other than hydrogen, Q represents a group of non-metal atoms which is required, together with C, to form a three to five membered hydrocarbon ring or a three to five membered heterocyclic ring which contains within the ring at least one hetero atom selected from the group consisting of N, S, O and P, $R_2$ represents a hydrogen atom, a halogen atom, an alkoxy group, an aryloxy group, an alkyl group or an amino group, $R_3$ represents a group which can be substituted onto a benzene ring, Y represents a hydrogen atom or a coupling-off group, l represents an integer from 0 to 4, and when l represents 2 or more the $R_3$ groups may be the same or different.

3. The silver halide color photographic material of claim 2, wherein $R_1$ is an alkyl group having 1 to 30 carbon atoms.

4. The silver halide color photographic material of claim 3, wherein $R_1$ is a methyl group or an ethyl group.

5. The silver halide color photographic material of claim 2, wherein Q represents a group of non-metal atoms which is required, together with C, to form a hydrocarbon ring having 3 to 30 carbon atoms.

6. The silver halide color photographic material of claim 2, wherein Y represents a heterocyclic group which is bonded to the coupling position with a nitrogen atom or an aryloxy group.

7. The silver halide color photographic material of claim 2, wherein $R_2$ represents a halogen atom, an alkoxy group, an aryloxy group, an alkyl group or an amino group.

8. The silver halide color photographic material of claim 2, wherein $R_3$ represents a carbonamido group having 1 to 30 carbon atoms or a sulfonamido group having 1 to 30 carbon atoms.

9. The silver halide color photographic material of claim 2, wherein l represents an integer 1 or 2.

10. The silver halide color photographic material of claim 1, wherein the amount of said acylacetamide type yellow coupler is from $1\times10^{-5}$ to $1\times10^{2}$ mol per square meter of the photographic material.

11. The silver halide color photographic material of claim 1, wherein said magenta coupler is represented by formula [M-I], [M-II], [M-III] or [M-IV] indicated below,

[M-I]

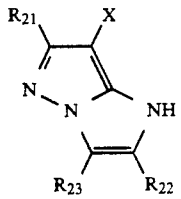

[M-II]

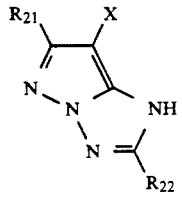

[M-III]

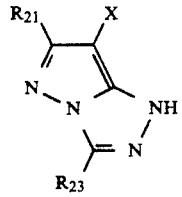

[M-IV]

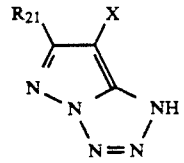

wherein $R_{21}$, $R_{22}$ and $R_{23}$ each represents a hydrogen atom, a halogen atom, an alkyl group, an aryl group, a heterocyclic group, a cyano group, a hydroxy group, a nitro group, a carboxy group, an amino group, an alkoxy group, an aryloxy group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and dimers may be formed with $R_{21}$, $R_{22}$ or $R_{23}$ as a divalent group; and X represents a hydrogen atom or a coupling-off group.

12. The silver halide color photographic material of claim 11, wherein $R_{21}$ represents an alkyl group, an aryl group, an alkoxy group, an aryloxy group, an alkylthio group, a ureido group, a urethane group or an acylamino group.

13. The silver halide color photographic material of claim 11, wherein X represents a hydrogen atom, a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a five or six membered nitrogen containing heterocyclic group, an imido group or an arylazo group.

14. The silver halide color photographic material of claim 13, wherein X represents a halogen atom, an alkoxy group or an aryloxy group.

15. The silver halide color photographic material of claim 11, wherein $R_{22}$ represents a hydrogen atom, an alkyl group, an aryl group, a heterocyclic group, an alkoxycarbonyl group, a carbamoyl group, a sulfamoyl group, a sulfinyl group, an acyl group or a cyano group.

16. The silver halide color photographic material of claim 11, wherein $R_{23}$ represents a hydrogen atom, an alkyl group, an aryl group, a heterocyclic group, an alkoxy group, an aryloxy group, an alkylthio group, an arylthio group, an alkoxycarbonyl group, a carbamoyl group or an acyl group.

17. The silver halide color photographic material of claim 11, wherein said magenta coupler is represented by formula [M-II] or [M-III].

18. The silver halide color photographic material of claim 1, wherein the amount of said magenta coupler is from 0.01 mmol to 1 mmol per square meter of the photographic material.

* * * * *